US010548210B2

(12) United States Patent
Eden et al.

(10) Patent No.: US 10,548,210 B2
(45) Date of Patent: Jan. 28, 2020

(54) CONTROL OF ELECTROMAGNETIC ENERGY WITH SPATIALLY PERIODIC MICROPLASMA DEVICES

(71) Applicant: The Board of Trustees of the University of Illinois, Urbana, IL (US)

(72) Inventors: J. Gary Eden, Champaign, IL (US); Paul V. Braun, Savoy, IL (US); Sung-Jin Park, Champaign, IL (US); Hee Jun Yang, Urbana, IL (US); Peng Sun, Urbana, IL (US); Runyu Zhang, Urbana, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 629 days.

(21) Appl. No.: 15/279,057

(22) Filed: Sep. 28, 2016

(65) Prior Publication Data

US 2017/0207523 A1 Jul. 20, 2017

Related U.S. Application Data

(60) Provisional application No. 62/233,610, filed on Sep. 28, 2015.

(51) Int. Cl.
*H05H 1/24* (2006.01)

(52) U.S. Cl.
CPC ..... *H05H 1/2406* (2013.01); *H05H 1/24* (2013.01); *H05H 2001/2412* (2013.01)

(58) Field of Classification Search
CPC ..... H05H 2001/2412; G02B 1/005; G02B 6/1225; B82Y 20/00
See application file for complete search history.

(56) References Cited

U.S. PATENT DOCUMENTS 8,957,572 B2 2/2015 Eden et al.
2015/0008825 A1* 1/2015 Eden ..... H05H 1/2406 315/111.21

OTHER PUBLICATIONS

B. Debord, "Generation and confinement of microwave gas plasma in photonic dielectric microstructure", 2013 Optics Express.*
Weili Fan, "A Potential Tunable Plasma Photonic Crystal: Applications of Atmospheric Patterned Gas Discharge" 2009 IEEE.*
Takui Sakaguchi "Photonic bands in two-dimensional microplasma arrays. II. Band gaps observed in millimeter and subterahertz ranges" 2007 American Institute of Physics.*

(Continued)

*Primary Examiner* — Maurice C Smith
(74) *Attorney, Agent, or Firm* — Greer, Burns & Crain, Ltd.; Steven P. Fallon

(57) ABSTRACT

Non-disperse, periodic microplasmas are generated in a volume lacking interfering structures, such as electrodes, to enable photonic interaction between incident electromagnetic energy and the non-disperse, periodic microplasmas. Preferred embodiments leverage 1D, 2D, 3D and super 3D non-disperse, periodic microplasmas. In preferred embodiments, the non-disperse, periodic microplasmas are elongate columnar microplasmas. In other embodiments, the non-disperse, periodic microplasmas are discrete isolated microplasmas. The photonic properties can change by selectively activating groups of the periodic microplasmas.

22 Claims, 25 Drawing Sheets

(56) References Cited

OTHER PUBLICATIONS

Guo, "Photonic band gap structures of obliquely incident electromagnetic wave propagation in a one-dimension absorbtive plasma photonic crystal", Physics of Plasmas, vol. 16, 043508, Apr. 28, 2009.
Sakai et al., "Interaction and control of millimetre-waves with microplasma arrays", Plasma Phys. Control. Fusion, vol. 47, pp. B617-B627, Nov. 9, 2005.
Sakai et al., "Photonic bands in two-dimensional microplasma arrays. I. Theoretical derivation of band structures of electromagnetic waves", Journal of Applied Physics, vol. 101, 073304, Apr. 6, 2007.
Sakai et al., "Plasmas as metamaterials: a review", Plasma Sources Sci. Technol., vol. 21, 013001, Jan. 31, 2012.

* cited by examiner

32

CONTROL OF ELECTROMAGNETIC ENERGY WITH SPATIALLY PERIODIC MICROPLASMA DEVICES

PRIORITY CLAIM AND REFERENCE TO RELATED APPLICATION

The application claims priority under 35 U.S.C. § 119 from prior provisional application Ser. No. 62/233,610, which was filed Sep. 28, 2015.

STATEMENT OF GOVERNMENT INTEREST

This invention was made with government support under FA9550-14-1-0002 and FA9550-14-1-0371 awarded by Air Force Office of Scientific Reasearch. The government has certain rights in the invention.

FIELD

Fields of the invention include electromagnetic devices, including filters and routers, photonics, three dimensional photonic crystals, and microplasma devices. Example applications include the re-directing or storing of electromagnetic energy, including electromagnetic energy in the microwave, mm-wave, or THz spectral regions. Specific example applications include bandpass filters, beamsplitters or routers, attenuators, and phase shifters for frequencies up to and beyond 1 THz. Additional applications include radar, radio astronomy, remote sensing, and telecommunications, all of which can involve the use of a portion of the electromagnetic spectrum and the reflection, transmission, and temporary storage of electromagnetic energy by methods and devices of the invention.

BACKGROUND

Photonic crystals were originally proposed by Eli Yablonovich and are based on the discontinuity in the index of refraction in a spatially-modulated structure. In one dimension, a photonic crystal is similar to a multilayer, dielectric mirror in which the index of refraction is alternated from layer-to-layer. Practical photonic crystals, such as the "log pile" structure, have typically been realized in solid materials by alternating, on a periodic basis, from one material to another. The crystals have been applied in numerous contexts, including optical communications, to achieve effective control over propagating electromagnetic waves. One drawback of photonic crystals constructed of two or more materials is that the properties of the crystal are fixed and not readily reconfigurable. Therefore, the electromagnetic properties of the crystal cannot be quickly varied with time.

Plasma has been proposed previously as a dielectric medium suitable for photonic crystals. See, Sakai, O., Sakaguchi, T., Ito, Y. & Tachibana, K., "Interaction and control of millimetre-waves with microplasma arrays," Plasma Phys. Control. Fusion 47, B617-B627 (2005); Sakai, O. & Tachibana, K., "Plasmas as metamaterials: a review," Plasma Sources Sci. Technol. 21, 013001 (2012); Sakai, O., Sakaguchi, T. & Tachibana, K., "Photonic bands in two-dimensional microplasma arrays," I. Theoretical derivation of band structures of electromagnetic waves. *J. Appl. Phys.* 101, 073304 (2007). Sakai et al. demonstrated as photonic crystals two dimensional arrays of plasmas having electron densities ($n_e$) in the range of $10^{11}$ to $10^{13}$ $cm^{-3}$. Because of the size of the plasmas (nominally 2 mm in diameter) and the overlap between adjacent plasmas, the crystals reported were capable of only small attenuations at the wavelength(s) of interest. A one dimensional plasma photonic crystal was also proposed in Guo, B. "Photonic band gap structures of obliquely incident electromagnetic wave propagation in a one-dimension absorptive plasma photonic crystal". Phys. Plasmas 16, 043508 (2009

The work of Tachibana and colleagues employed two dimensional (2D) microplasma arrays that produced spatially-disperse plasmas (i.e., not uniform in diameter). Attenuation of 60 GHz microwave signals was observed in these experiments but the magnitude of the suppression was small. Sakai et al. generated columnar plasmas ~2 mm in diameter in a periodic, two-dimensional structure that had an overall area of 44 mm×44 mm, but converting this structure into three dimensions is problematic because of the electrode configuration and structure geometry. Guo proposed a one dimensional design for a plasma-based photonic crystal that similarly is not readily extendable to two or three dimensions. The weak attenuation of incident electromagnetic energy and the restriction of previous plasma photonic crystal designs to one or two dimensions suggest that the prior art does not offer structures capable of competing with photonic crystals fabricated from solids, or for capturing the inherent advantages that plasma-based photonic crystals have with respect to tunability and reconfigurability.

SUMMARY OF THE INVENTION

Preferred embodiments include methods and photonic crystals that leverage non-disperse (i.e., spatially-uniform), periodic microplasmas are generated in a volume lacking interfering structures, such as electrodes, to enable photonic interaction between incident electromagnetic energy and the non-disperse, periodic microplasmas. Preferred embodiments leverage 1D, 2D, 3D and super 3D non-disperse, periodic microplasmas. In preferred embodiments, the non-disperse, periodic microplasmas are elongated columnar microplasmas. In other embodiments, the non-disperse, periodic microplasmas are discrete isolated microplasmas. The photonic properties can be altered by selectively activating groups of the periodic microplasmas.

BRIEF DESCRIPTION OF THE DRAWINGS

FIGS. 1A-1C are schematic perspective illustrations of the microplasma arrangement of a super 3D (three dimensional) microplasma photonic crystal according to a preferred embodiment of the invention;

DETAILED DESCRIPTION OF THE PREFERRED EMBODIMENTS

Figure 1A:
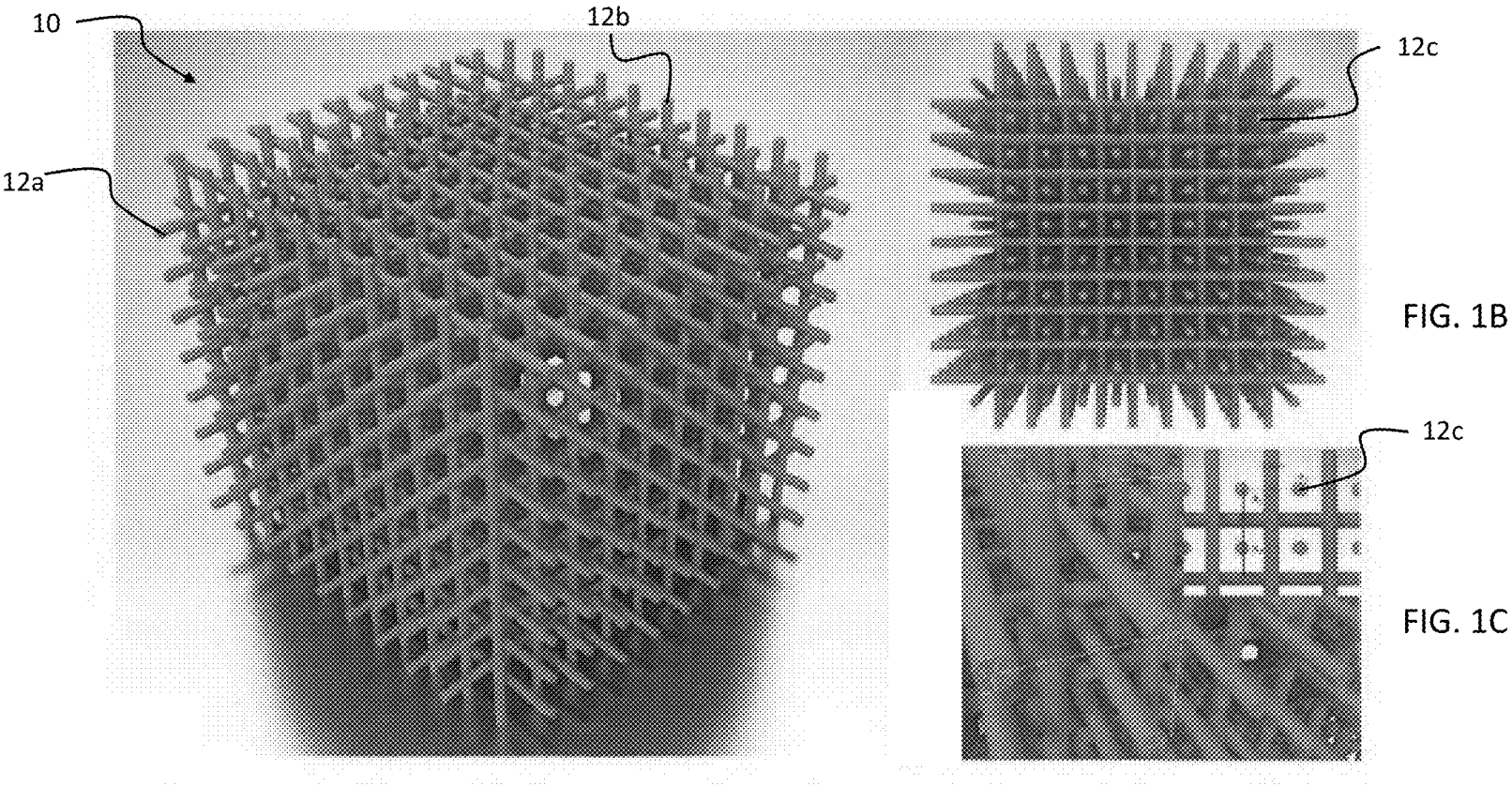

Preferred embodiments provide electromagnetic devices using a photonic crystal based upon microplasma generation. Preferred embodiments also include methods for controlling incident electromagnetic energy with microplasma columns, or with periodic, layered dielectric structures that are filled with plasma produced by external electrodes. Devices and methods of the invention can selectively reflect, transmit and temporarily store incident electromagnetic energy within predetermined wavelength ranges.

Methods and crystals of the invention include non-disperse, periodic microplasmas in a volume lacking interfering structures, such as electrodes, to enable a photonic interaction between incident electromagnetic energy and the non-disperse, periodic microplasmas. Preferred embodiments leverage 1D, 2D, 3D and super 3D non-disperse, periodic microplasmas. In preferred embodiments, the non-disperse, periodic microplasmas are elongate columnar microplasmas. In other embodiments, the non-disperse, periodic microplasmas are discrete, isolated microplasmas.

An embodiment of the invention includes two, two-dimensional (2D) arrays of well-defined, non-disperse plasma columns in an empty volume that intersect at an angle. The resulting three dimensional structure has plasma columns that intersect, and others that do not. Each of the plasma columns is addressable, enabling the frequency transmission and reflection characteristics of the crystal to be altered at electronic speeds. Another embodiment of the invention is a three dimensional, layered scaffold, a periodic structure fabricated from a dielectric in which discrete isolated microplasma is formed in the regions between the layers by electrodes outside the scaffold.

In some embodiments of microplasma photonic crystals of the invention, two or three sets (arrays) of microplasma columns are oriented at an angle with respect to each other so as to form a two or three-dimensional plasma structure. In arranging the positions of the plasma columns, the geometry of the resulting system can be such that any specific column from one array can intersect a column associated with the other. Alternatively, one or more of the columns may not intersect another column but, rather, may be offset from others. All or part of one array of plasma columns can be interleaved with another. The result of intersecting or interleaving one array of plasma columns with those of at least one other array is to produce microplasma columns in various patterns, some of which can be intricate and lead to useful behavior in microwave, sub-mm, and terahertz (THz) systems. Examples of the patterns possible include cubic, tetrahedral, and cylindrical geometries. The simplest of these is the geometry in which the plasma columns cross at a right angle and form a three-dimensional, cubic microplasma structure. One application of the microplasma structure itself is the control of the transmission, reflection, or resonance (storage within the crystal) of electromagnetic energy. A primary asset of such plasma crystals is that the frequency-dependent characteristics of the photonic crystal can be modified "on the fly" because the individual plasma columns comprising the arrays can be addressed, e.g. turned on or off at will.

The microplasma columns are arranged in a spatially-periodic structure having a specified plasma column-to-column spacing (pitch λ), average electron density ($n_e$), and plasma column diameter (d). Each of these parameters is chosen such that the crystal transmits, reflects, or captures (internally) electromagnetic radiation of the desired frequency, or range in frequencies. In some embodiments, the plasma columns are provided by arrays of microplasma jets in an empty volume. In other embodiments, the plasma columns are produced in arrays of capillaries in a microstructure. Additional embodiments are based upon a cubic scaffold of intersecting or interleaved capillaries. In all embodiments, a photonic volume exists in which microplasmas and incident electromagnetic energy interact freely without electrodes that might interfere with the operation of the photonic crystal.

Additional embodiments of the invention include three dimensional dielectric structures that are periodic, and the regions between the dielectric layers are largely filled with plasma produced by electrodes external to the structure. The 3D printing process enables the dielectric layers to be produced to have features to define isolated discrete volumes of microplasma (arrays of microcylinders, microcubes, etc.) with dimensions comparable to the wavelength of electromagnetic radiation in the microwave, mm, sub-mm, THz, and infrared regions. The preferred multilayer dielectric structures can generate a periodic pattern of discrete, low temperature microplasmas to realize electromagnetic properties that are modulated by the microplasmas filling a portion or all of the structure.

Microplasma photonic crystals of the invention are capable of re-directing or storing electromagnetic energy in the microwave, mm-wave, THz, or infrared spectral regions. Depending on the particular design of the microplasma photonic crystal in accordance with the invention, a periodic structure having a volume less than 1 cubic cm, for example, can serve as a reconfigurable bandpass filter, beamsplitter or router, attenuator, or phase shifter for frequencies up to and beyond 1 THz. The frequency region in which a given microplasma photonic crystal operates will be determined primarily, in preferred embodiments of the invention, by the plasma column pitch, diameter, and the electron density. In other embodiments, plasma photonic crystals will comprise a number of layers (one-half cycle in the refractive index, each layer having a specific surface structure) and the number of layers in a given crystal, as well as the dimensions of the geometric elements in each layer, is also a determinant of the electromagnetic properties of the crystal.

One preferred embodiment generates microplasma columns in a predetermined column-to-column spacing (pitch λ), average electron density ($n_e$), and plasma column diameter (d). Calculations of the bandgap associated with a particular plasma column geometry can predict accurately the photonic response of the resulting plasma column geometry to radiation in a predetermined wavelength range. The geometry chosen can be designed to optimize the reflection, transmission and/or storage of incident electromagnetic energy for a specific application. Preferred embodiments leverage plasma jet columns. Other preferred embodiments leverage microplasma of different shapes confined in 3D microstructures.

Other embodiments of the invention are photonic crystals formed from periodic arrays of discrete microplasma confined within layered 3D microstructures. The layered microstructures can be formed, for example, through a layer-to-layer building process enabled by 3D printing. Layers of pre-designed microstructures form a two or three-dimensional structure. Microplasma generated in all or a portion of the regions between the layers provides plasma photonic crystal arrays in three dimensions that are capable of manipulating electromagnetic radiation, and varying those properties in real time by modulating the properties of the plasma (through the voltage, for example, or the voltage pulse format, etc.) or simply extinguishing and igniting the plasma.

Photonic crystals of the invention can control the transmission, reflection, or storage (within the crystal) of electromagnetic energy. A great advantage is provided by microplasma photonic crystals of the invention because characteristics of the crystal are not fixed. Instead, the characteristics can be modified in real time (e.g., "on the fly") because the plasma within all embodiments can be turned on or off at will, or the plasma properties can be altered through the voltage that produces the plasma, and through the properties of the dielectric in proximity to the plasma.

The microplasma photonic crystals can be arranged in a spatially-periodic structure having a calculated plasma column-to-column spacing, average electron density, and plasma column diameter. Each of these parameters is chosen such that the crystal transmits, reflects, or captures (internally) electromagnetic radiation of the desired frequency, or range in frequencies.

Arrays of microplasma photonic crystals of the invention are capable of re-directing or storing electromagnetic energy, including in the microwave, mm-wave, or THz spectral regions. The invention provides flexibility over the particular design of the photonic crystal, which can be configured to achieve particular reflective, transmission, or storage objectives. Exemplary experimental microplasma photonic crystals have been demonstrated, for example, that comprise a periodic structure having a volume larger than 16.25 cubic cm (to date). Such a photonic crystal can serve as a reconfigurable bandpass filter, beam splitter or router, attenuator, or phase shifter for frequencies up to and beyond 1 THz.

In example embodiments of this invention, the plasma columns are provided by arrays of microplasma jets. In other embodiments, plasma devices are realized by arrays of dielectric structures that confine discrete plasmas (in a specific crystal geometry) and can be formed by 3D printed layers or another fabrication process.

Preferred embodiments provide a dynamic (capable of being altered in real time), three dimensional microplasma photonic crystal that is tunable. That is, the frequency or transmission characteristics of the microplasma are not static. The frequency characteristics are instead dynamic in the sense that the characteristics can be controlled by the selective operation, or altering the properties, of microplasmas within the photonic crystal. The dynamic photonic crystal, therefore, provides a tunable and reconfigurable material system for electromagnetic responses in the millimeter wave region or at higher frequencies, such as those in the terahertz or infrared spectral regions.

In preferred embodiments, a microplasma photonic crystal includes a plurality of separately-controlled microplasma arrays arranged in an isotropic geometry in three dimensions. The microplasma arrays can be dynamically controlled. The capability of controlling the arrays of microplasma as a dynamic material in three dimensions, in combination with the isotropic geometry, provides control over the electromagnetic response of the microplasma crystal, including but not limited to its photonic band gap. Oscillations of the stop band region and considerable signal control have been demonstrated through simulations investigating the variation of the photonic column diameter and layer-to-layer spacing in example microplasma photonic crystals of the invention. Experiments have also confirmed the simulations in physical devices.

Microplasma photonic crystals of the invention have been simulated and evaluated, and also demonstrated in experimental embodiments. Systematic interpretations of the electromagnetic responses of preferred embodiment microplasma photonic crystals have been evaluated through finite difference time domain (FDTD) simulations for electron densities ($n_e$) ranging from $10^{15}$ $cm^{-3}$ to $10^{17}$ $cm^{-3}$ in a semi-infinite photonic crystal consisting of 3D simple cubic unit cells with a lattice constant of 1 mm and a diameter of 450 μm for each microplasma column (PC).

Preferred embodiments provide super 3D microplasma photonic crystal microstructures. These super 3D structure configurations provide dramatic photonic crystal (PC) responses. A significant photonic stopband is observed for an intermediate electron density level ($>1\times10^{15}$ $cm^{-3}$) when the permittivity contrast between the plasma and the background material becomes sufficiently large. Such a contrast can be achieved in preferred 1D, 2D, 3D and super 3D embodiments via non-disperse and narrow diameter plasma columns generated in an empty volume (volume only having plasma medium or a background gas). For example, preferred embodiments can generate plasma columns in an empty volume having a diameter of ~50-500 μm that is non-disperse, i.e. the diameter varies by less than 50%, more preferably less than 20% and most preferably less than 10% over the full interaction length (length that encounters incident electromagnetic energy). Such a contrast can also be produced in embodiments that use confined, discrete microplasmas in a periodic dielectric structure.

Example 2D and 3D microplasma photonic crystals have been demonstrated with columns having diameters of 100-500 μm, and an interaction volume of 6 mm×6 mm×6 mm.

Preferred embodiments provide 1D, 2D, 3D and super 3D microplasma photonic crystal microstructures. The super 3D configuration, in particular, provides strong photonic crystal (PC) attenuation. For example, attenuations >60% are observed for moderate electron densities ($>1><10^{15}$ $cm^{-3}$) at frequencies up to and beyond 1 THz, assuming the collision frequency for momentum transfer to be approximately 1 GHz. That is, the region between the plasma columns should be at low pressure or in vacuum.

In several embodiments of the invention, microplasmas are relied upon as the only dielectric medium (except for the gaseous medium between the plasmas). The dielectric permittivity c of plasma can be estimated from the Drude model expression:

$$\varepsilon_p = 1 - \frac{\omega_p^2}{\omega^2(1 + j\nu/\omega)} = 1 - \frac{e^2 n_e}{\varepsilon_o m_e \omega^2 (1 + j\nu/\omega)},$$

where $\omega_p$, the plasma frequency, is directly proportional to the square root of the electron density ($n_e$). Both the real (ε) and imaginary parts (ε") of the permittivity $\varepsilon_p$ are dependent on $\omega_p$ and the collision frequency for momentum transfer ν. Owing to the prominent role of $n_e$, which can be controlled dynamically by electronics, ε and ε" are, therefore, also variable. Microplasma is a term given to plasma which is confined in at one spatial dimension to a cavity of mesoscopic dimensions (nominally less than 1 mm) Typical values for the volumes of such cavities are nanoliters to microliters. Producing microplasma generally requires a power density of $10^4$ to $10^6$ W $cm^{-3}$ with $n_e$ ranging from $10^{13}$ to $10^{17}$ $cm^{-3}$, which corresponds to $\omega_p$ on the order of 30 GHz ($\lambda_p$=10 mm) to 3 THz ($\lambda_p$=100 μm). This wavelength range is interesting for a number of applications, including radio astronomy, remote sensing, radar and telecommunications.

Preferred embodiments provide a reconfigurable super 3D microplasma crystal formed from intersecting plasma column arrays. Super 3D microplasma crystals are capable of moving a region of high spectral attenuation (for example) from wavelength (frequency) region to another by "dropping" (extinguishing) one microplasma column, or an entire row or column in an array. The confinement of plasma into capillaries in preferred embodiments enables the attainment of values of $n_e$ not accessible with larger volume plasmas. Furthermore, the modulation of the plasma column properties, through the driving voltage, can provide control of the power loading and the concomitant electron density in individual plasma columns. This, in turn, alters the spectral properties of the entire crystal.

One preferred embodiment provides 3D microplasma photonic crystals comprising microplasma columns that intersect or pass each other with a vertical or horizontal offset, so as to realize a three dimensional region having a specified plasma geometry. The microplasma columns all traverse a "photonic interaction" volume, and are selectively activated so as to permit switching between 1D, 2D and 3D photonic crystal operation.

Preferred embodiments of the invention will now be discussed with respect to the drawings. The drawings may include schematic representations, which will be understood by artisans in view of the general knowledge in the art and the description that follows. Features may be exaggerated in the drawings for emphasis, and features may not be to scale.

FIGS. 1A-1C illustrate the plasma pattern in a preferred embodiment microplasma super 3D photonic crystal 10. Interleaved columns of plasma 12*a* and 12*b* emanating from two separate arrays are arranged so as to form a cubic pattern as they intersect. Additional columns of plasma 12*c* are disposed so as to pass through the center of the square cross-sectional cells formed by the microplasma columns 12*a* and 12*b*, but not intersecting the columns 12*a* and 12*b*. The arrangement of the plasma channels shown in FIGS. 1A-1C is only one of many that are possible—that is, various geometries may be formed by the intersection of two or more arrays of plasma columns. It must be emphasized that the spectral characteristics of each geometry will be unique but can be determined by calculations and testing. For simplicity of illustration of preferred embodiments, unit cells in FIG. 1 are arranged in a cubic structure with the lattice constant set to be a=1 mm. More generally, a can range from the millimeter to meter scales. The diameter d of the plasma columns is less than 1 cm and preferably falls in the range of 50 to 500 μm and the spacing between the orthogonal layers is defined to be 1. In example laboratory experimental devices, values of a as low as 100 μm have been realized. Commercial fabrication can produce lower values. Progressively higher frequencies can benefit from a values below 100 μm. The diameter d of the experimental plasma columns was in the range of 100 to 500 μm, but can be reduced to 50 μm or less with the same fabrication process, and the spacing between the orthogonal layers is defined to be 1, a parameter selected to achieve a particular frequency response from the crystal. The response of most plasma crystals (like photonic crystals, in general) also depends on the direction at which an incoming electromagnetic signal approaches the crystal.

Figure 2B:
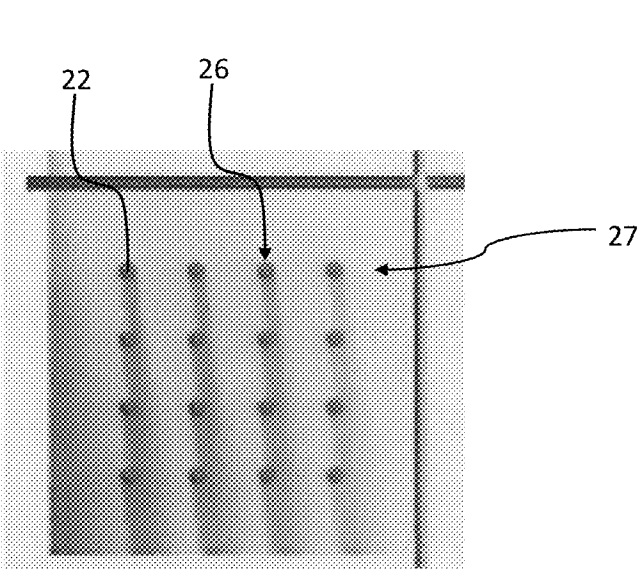
FIGS. 2A and 2B are schematic illustrations of the microplasma arrangement and a portion of a 2D microplasma photonic crystal according to a preferred embodiment of the invention.
Figure 2A:
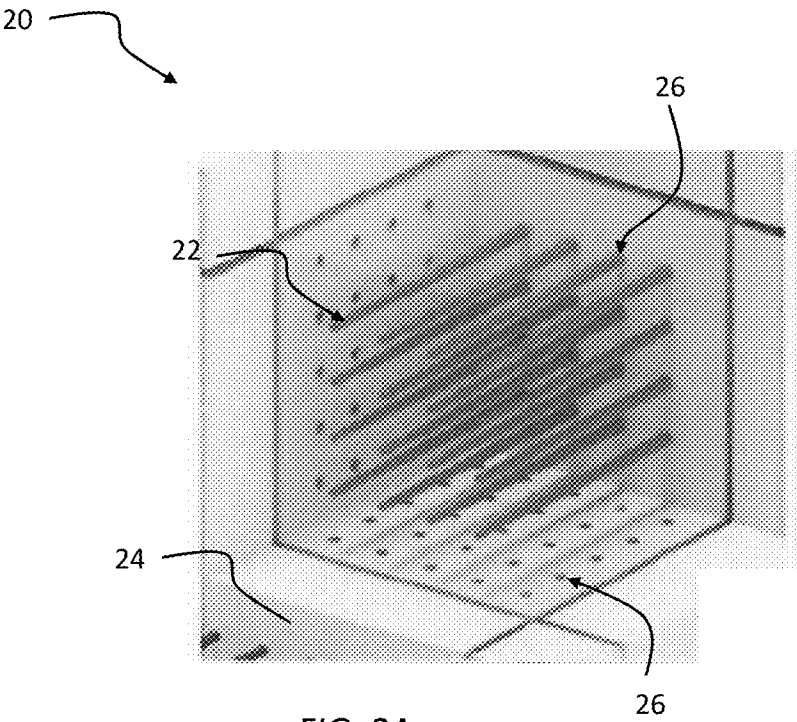
Figures 2C, 2D:
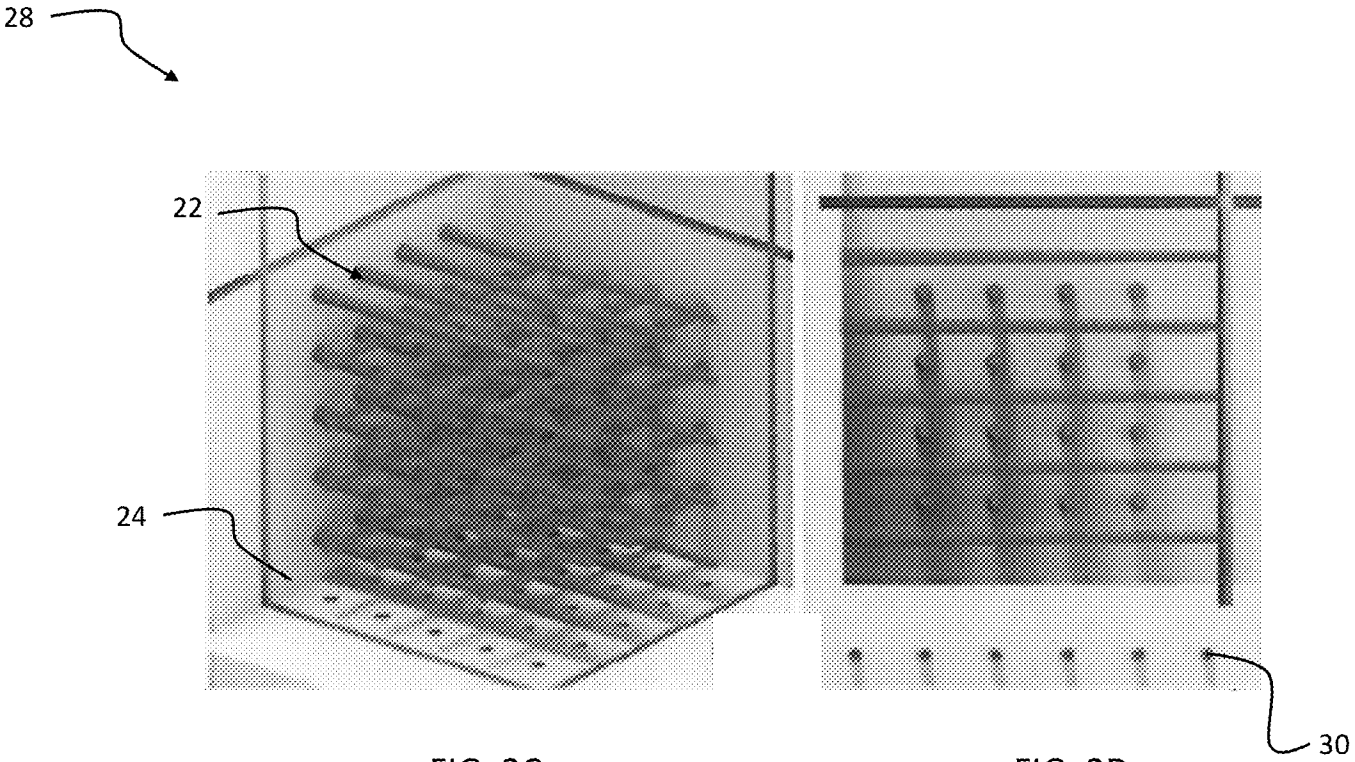
FIGS. 2C and 2D are schematic illustrations of the microplasma arrangement and a portion of a 3D microplasma photonic crystal according to a preferred embodiment of the invention.
Figure 2F:
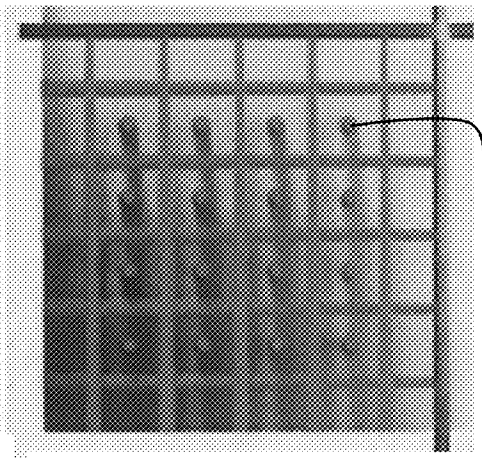
FIGS. 2E and 2F are schematic illustrations of the microplasma arrangement and a portion of a super 3D microplasma photonic crystal according to a preferred embodiment of the invention.
Figure 2E:
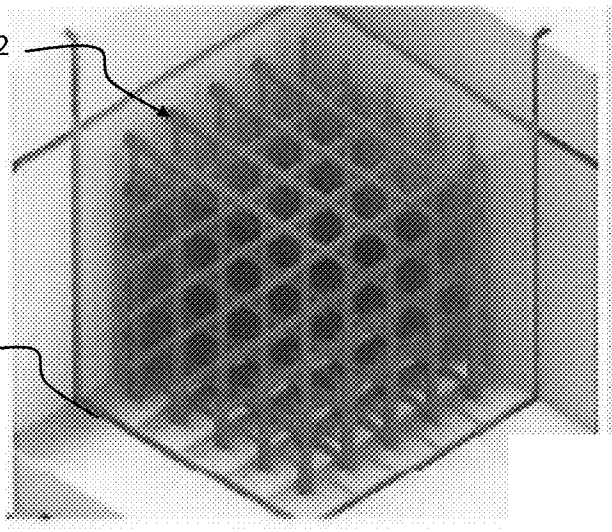

FIGS. 2A and 2B illustrate the microplasma pattern for a 2D microplasma photonic crystal 20. Non-disperse, well-formed microplasma columns 22 are parallel to one another. As seen in FIG. 2B, the microplasma columns 22 are arranged in a square pattern, but other periodic patterns can be used. For example, one or both of the intersecting arrays forming a crystal (2D or 3D) can be in the form of a hexagon (e.g., honeycomb) or diamond arrangement. A surrounding structure 24 contains electrodes (not shown) and nozzle ports 26 for microplasma jets that form the plasma columns 22. A group 27 of ports 26 in a common plane is itself a 1D array, and the individual 1D arrays can be selectively turned on or off via control of electrodes that power the microplasma columns 22. FIGS. 2C and 2D illustrate the microplasma pattern of a 3D microplasma photonic crystal 28. The microplasma columns form a 3D interleaved pattern from the same surrounding structure 24 as that shown in FIGS. 2A and 2B. FIG. 2D also illustrates the sustaining electrodes 30 embedded in the microstructured dielectric block 24. FIGS. 2E and 2F illustrate the microplasma pattern of a super 3D microplasma photonic crystal 32. The microstructure is as illustrated in FIGS. 2A-2D, but additional microplasma columns 34 pass through the center of the square cross-sectional cells formed by the microplasma columns 22. Both of the 2D and 3D geometries can often be anisotropic, in the sense that the crystal structure is not azimuthally symmetric, even if the incoming electromagnetic wave approaches the crystal along an axis orthogonal to one face of a cubic crystal. Because the incoming wave is characterized by a polarization that describes the orientation of the electric field, the crystal is said to be anisotropic. However, if the structure of FIG. 2C is viewed from the side as in FIG. 2D, the two crossing channel arrays intersect orthogonally, and both lie at right angles to the incoming radiation. Therefore, in this orientation, the crystal of FIG. 2D appears to be isotropic and its spectral characteristics are polarization independent. The super 3D embodiment of FIGS. 2E and 2F is unique in that it offers the same geometry, and provides the same electromagnetic response, from all the surfaces of the cube, regardless of the axis along which an electromagnetic wave propagates.

Figures 3A, 3B, 3C:
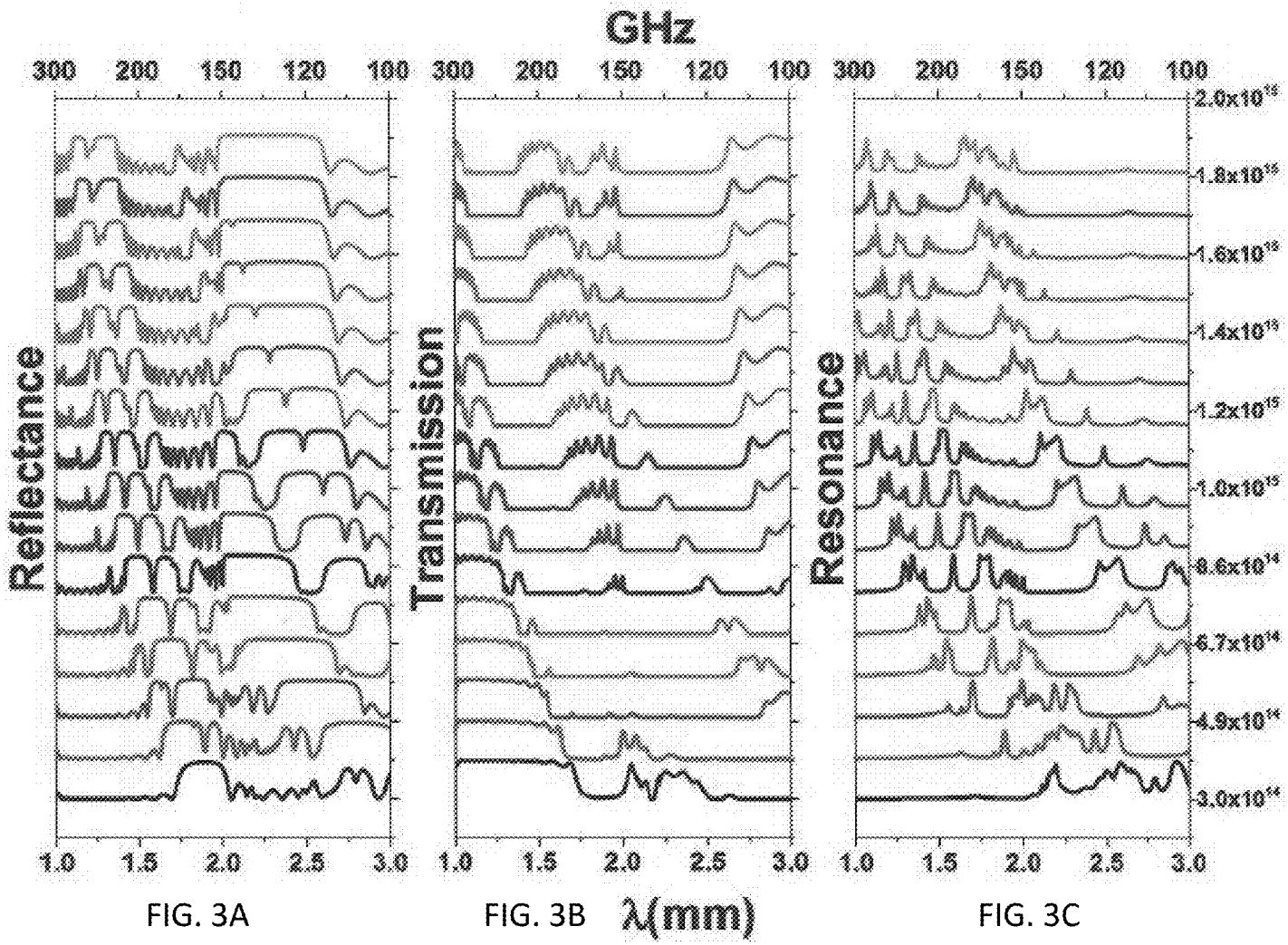
FIGS. 3A-3C are respective calculated plots showing the dependence on wavelength in the 1-3 mm range for reflectance, transmission and resonance (storage) of energy incident on a 2D microplasma photonic crystal constructed according to a preferred embodiment of the invention.

FIGS. 3A-3C provide representative results from detailed calculations and simulations of the electromagnetic properties of a 2D microplasma crystal having a column pitch of 1 mm, and a plasma column diameter d of 355 μm. The dependence of the individual spectra on the electron density is also provided. Electron density is an important parameter of any plasma photonic crystal because it determines the magnitude of the contrast in refractive index encountered by an electromagnetic wave as it propagates through the crystal. The data in FIGS. 3A-3C were obtained for normal incidence of the incoming wave onto one of the crystal's faces, and for 16 values of electron density ranging from $3\times10^{14}$ $cm^{-3}$ to $1.8\times10^{15}$ $cm^{-3}$. Microplasma can currently be generated within and beyond this range of density values. The reflectance spectra of FIG. 3A show, for example, that the reflectivity of the crystal varies with wavelength over the 1-3 mm region, and higher reflectivity is realized at shorter wavelengths as the electron density is increased. Similar trends are observed in the transmission spectra of FIG. 3B. The resonance spectra of FIG. 3C account for energy that is trapped within the crystal. This indicates that the microplasma photonic crystal is capable of temporarily storing energy in the crystal. Because the plasma columns in the crystal can be addressable, energy in specific spectral regions can be trapped and then released at will by selective activation and deactivation of plasma columns.

Figure 4:
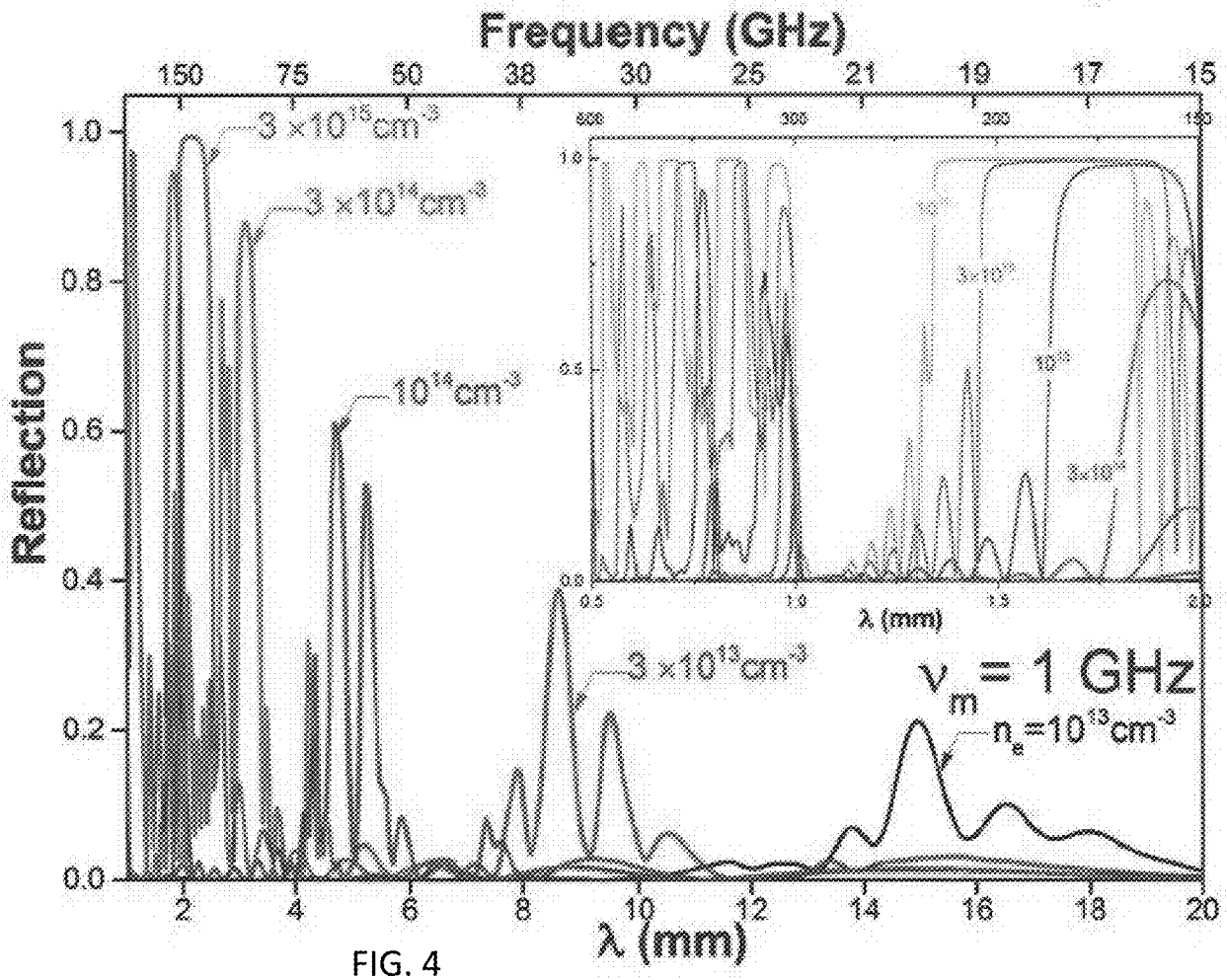
FIG. 4 includes calculated reflectance spectra (for several values of electron density and assuming the collision frequency for momentum transfer to be 1 GHz) for a 2D microplasma photonic crystal constructed according to a preferred embodiment of the invention.

FIG. 4 provides a detailed summary of the frequency characteristics of a 2D crystal (pitch of 1.0 mm) in the 0.5-2.0 mm wavelength range. Simulation results are (for the sake of clarity) shown for only six values of electron density. The inset expands the 0.5-2.0 mm wavelength interval. The data show that increasing the electron density results in: 1) the magnitude of the crystal reflectivity approaching unity as electron density exceeds $3\times10^{14}$ $cm^{-3}$, and 2) the regions of high reflectivity move to shorter wavelengths. Preferred methods and devices of the invention focus on spectral regions lying at frequencies lower than that of the plasma frequency (assuming a fixed electron density). An electron density of $10^{16}$ $cm^{-3}$, for example, implies a plasma frequency of 1 THz which corresponds to a wavelength of 0.3 mm (300 um). Thus, preferred embodiments exploit resonances in the behavior of a plasma photonic crystal occurring at frequencies lower than that of the plasma frequency. Microplasma photonic crystals also exhibit reflectivity, transmission and resonance at frequencies above the plasma frequency. However, preferred embodiments leverage the frequencies below the plasma frequency because of the reduced demands on the electron density in the crystal and, therefore, the power that must be delivered to the crystal.

One structure for generating the microplasma columns is based upon microplasma jets. Eden et al., U.S. Pat. No. 8,957,572, incorporated by reference herein, describes methods for fabricating microplasma jets in polymer blocks and in metal and metal oxide structures. As an example, the polymer structures of FIGS. 2A-7E of the '572 Patent include extended microcavities that can be spaced apart according to the desired plasma column-to-column spacing (pitch λ), average electron density ($n_e$), and configured to have a plasma column diameter (d). The jets that extend from the structures in FIGS. 2A-7E are suitable for use in a photonic plasma crystal of the invention, but electrodes within the polymer blocks and metal and metal oxide structures make the volume within such polymer blocks and metal and metal oxide structures unsuitable as a photonic crystal because the electrodes interfere with, absorb and reflect the incident electromagnetic energy. The present invention also extends and collimates the jets into columns, by including electrodes around the volume used for plasma-electromagnetic interaction. With electrodes arranged around the empty volume, well-formed plasma columns can be maintained over longer distances than those of the '572 Patent. In addition, backing pressure and plasma medium flow can be used to drive the plasma out of the capillaries or elongate microcavities. This is illustrated in the FIGS. 5A and 5B embodiments, as will be explained. In the '572 patent, the maximum jet length was about 1 cm, whereas the structures in FIGS. 2A-2F and 5A and 5B in the present application extend collimated, non-disperse and well-formed plasma columns that can extend through 1.5 cm, 2.5 cm and up to several cm in length, e.g. ~5-8 cm. Experiments have demonstrated ~5 cm lengths so far.

Figure 5A:
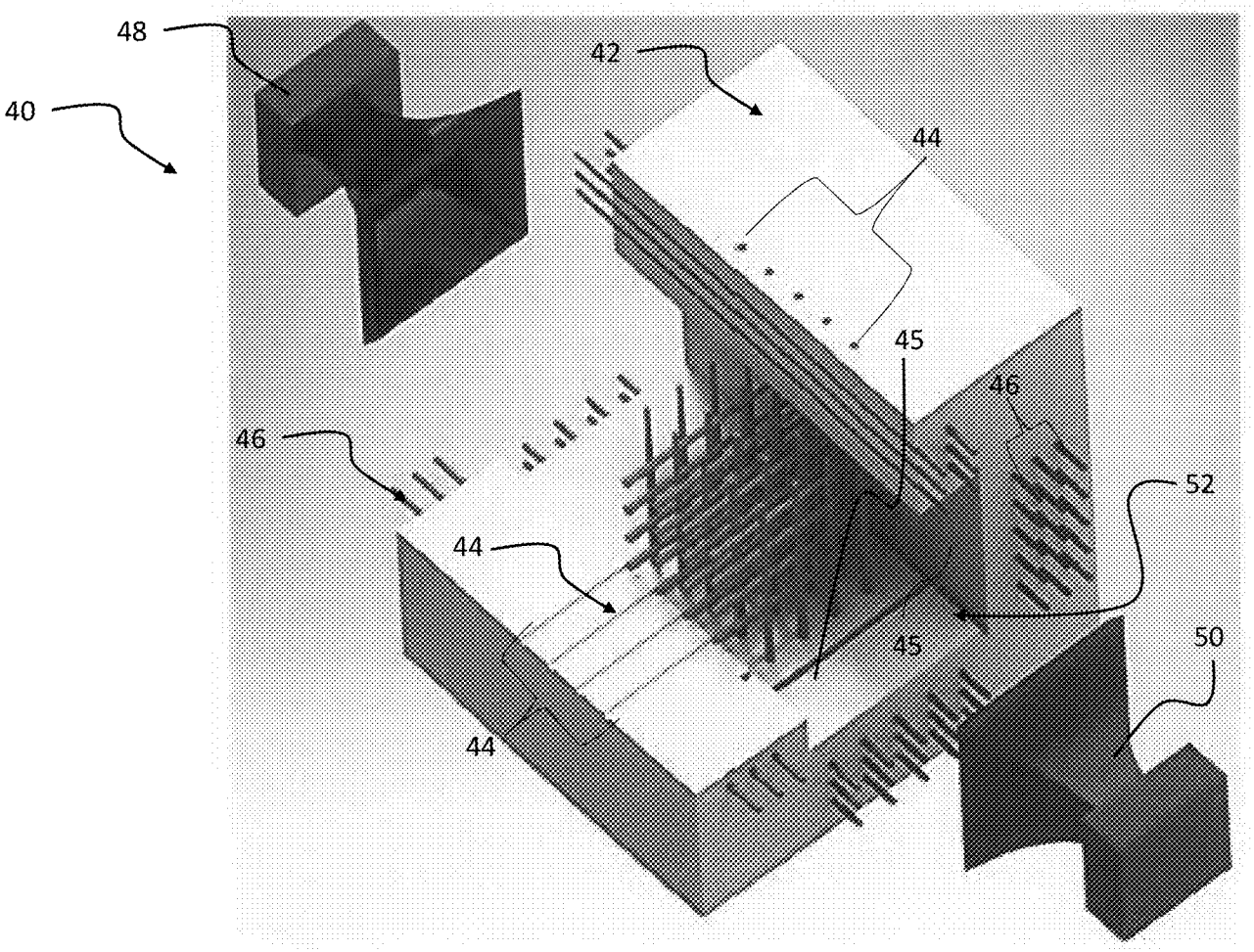
FIGS. 5A and 5B are partial, cut-away views of plasma jet-column based 3D microplasma photonic crystals according to a preferred embodiments of the invention.
Figure 5B:
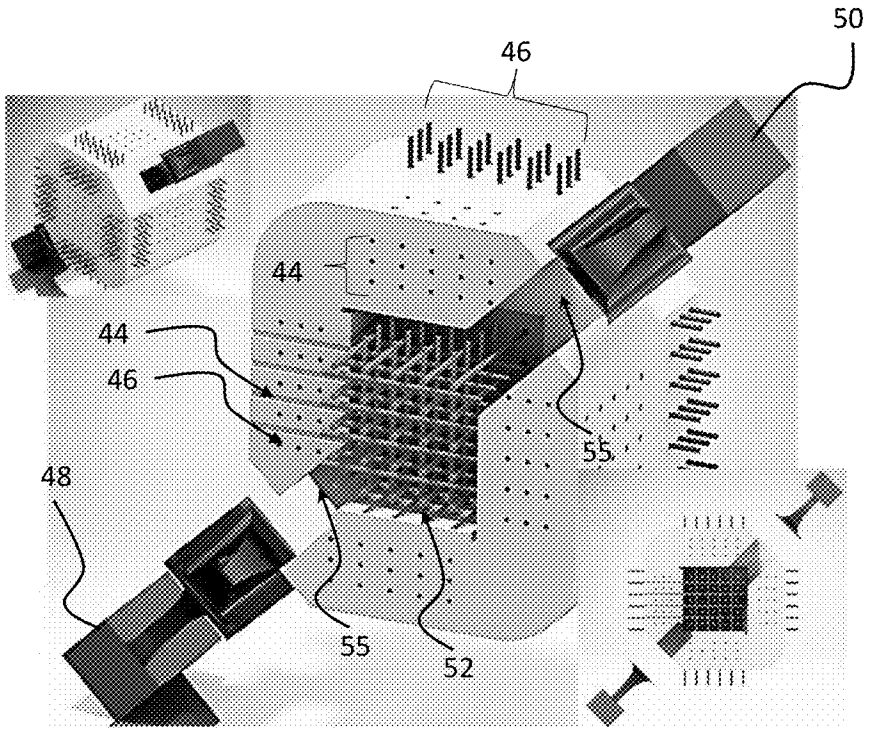

FIG. 5A illustrates a preferred embodiment 3D microplasma photonic crystal 40. An enclosure 42 can be fabricated from a variety of dielectric materials such as polymers, polycarbonate, and machinable ceramics, and defines arrays of elongate microcavities 44 in three orthogonal directions suitable for generating elongate microplasma columns in the form of collimated, non-disperse jets according to a pattern consistent with FIGS. 1A-1C and 2A-2F. Arrays of elongate electrodes 46 in three orthogonal directions pass through the enclosure material (wall) in close proximity (closer than the distance between adjacent plasma columns) to the arrays of microcavities 44 and provide the power necessary for producing plasma within the enclosure 42. The arrays of elongate microcavities 44 open to at least 4 interior surfaces 45 of the enclosure 42, and opposite elongate microcavities are aligned with each other. A microwave horn 48 launches a microwave signal into the crystal, and another microwave horn 50 captures the signal transmitted by the crystal. The enclosure 42 defines an empty central volume 52 traversed by the microplasma columns, and windows may be installed on each end of the open region. If the plasma columns are produced by jets having a backing pressure, the enclosure 42 may include a simple pressure vent. The arrays of electrodes 46 surround all sides of the empty central volume 52 and run orthogonally to the arrays of microcavities 44, which helps maintain the collimated, non-disperse columns of plasma. FIG. 5B illustrates a similar super 3D microplasma photonic crystal with a differently shaped enclosure. In this embodiment, arrays of elongate microcavities 44 open to 6 interior surfaces of the empty volume to create the super 3D pattern of plasma columns. In FIG. 5B, windows 55 and the horns 48 and 50 are disposed at an angle to the plasma columns generated in the empty volume 52. FIG. 5B also shows clearly the alternating and orthogonal arrays of elongate microcavities 44 and electrodes 46.

Figure 6:
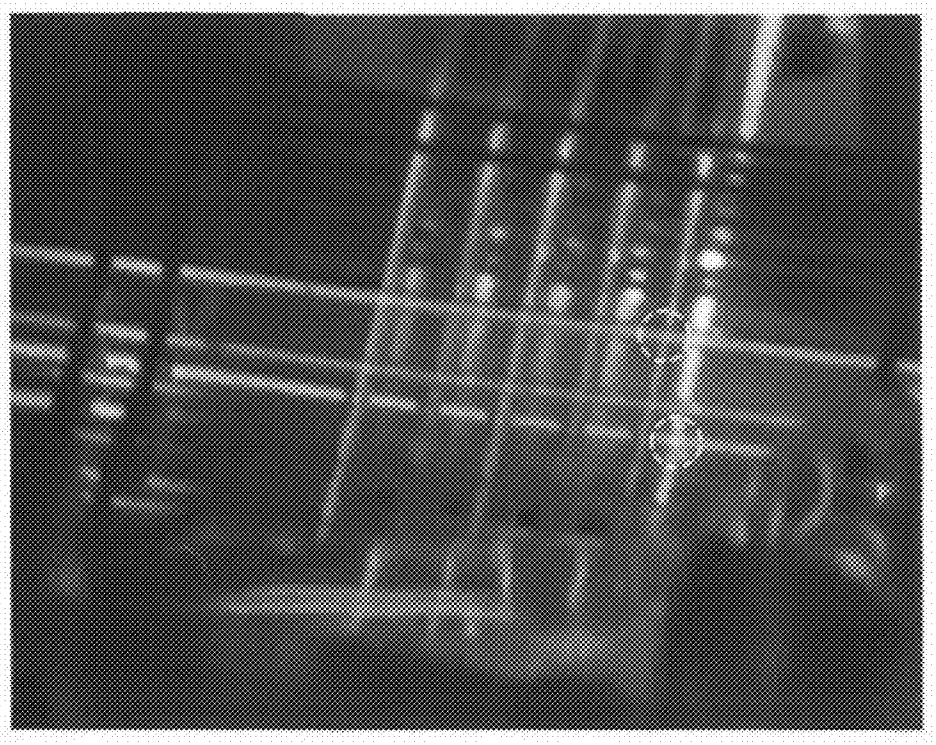
FIG. 6 is a photograph illustrating plasma jet columns intersecting in accordance with 3D microplasma photonic crystal preferred embodiments of the invention.

FIG. 6 shows microplasma columns formed from jet arrays, interleaved and crossing at an angle of 90 degrees, that have been realized in the laboratory. One array can be seen at upper right in the photograph with the plasma columns extending downward and to the left. This array is a 2×5 configuration and its plasma jets pass above the plasma columns produced by a second array. The second array of jets in FIG. 6 is a partial 2×5 configuration, which originates at the left of the photograph and proceeds to the right. Although the array at left is not fully functioning, the plasma columns produced by the two arrays are interleaved as required for a 3D array, and the upper dashed circle of FIG. 6 indicates just one of the points where the five upper plasma jets produced by the upper right array pass above one of the plasma columns generated by the left array. The lower dashed circle in FIG. 6 indicates a point where the lower plasma column produced by the left array passes below one of the five lower jets generated by the array at upper right. FIG. 6 is an image of a simple but successful 3D plasma photonic crystal design that includes two interleaved 2×5 arrays of plasma columns.

Figure 7B:
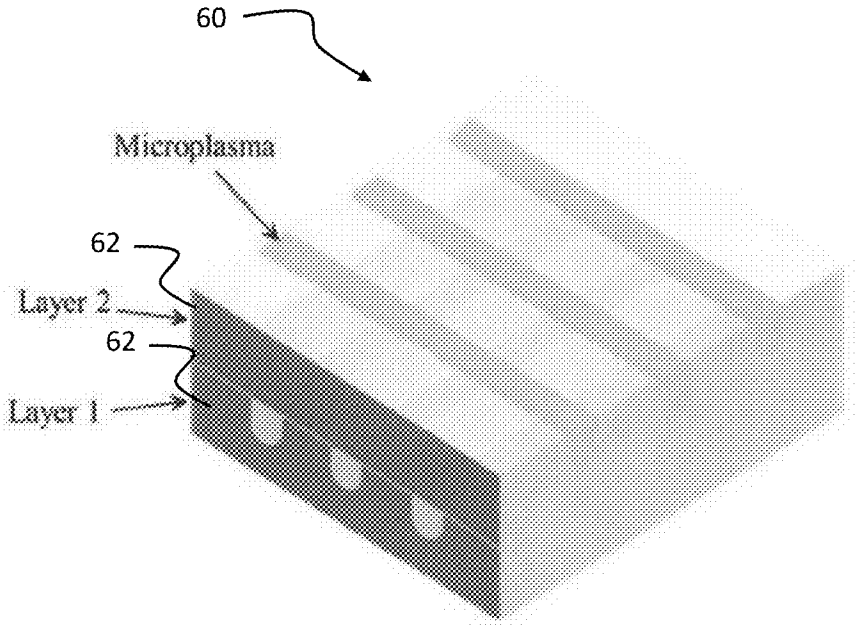
FIGS. 7A and 7B illustrate a layered microstructure microplasma photonic crystal according to a preferred embodiment of the invention in which microplasma is confined in capillaries.
Figure 7A:
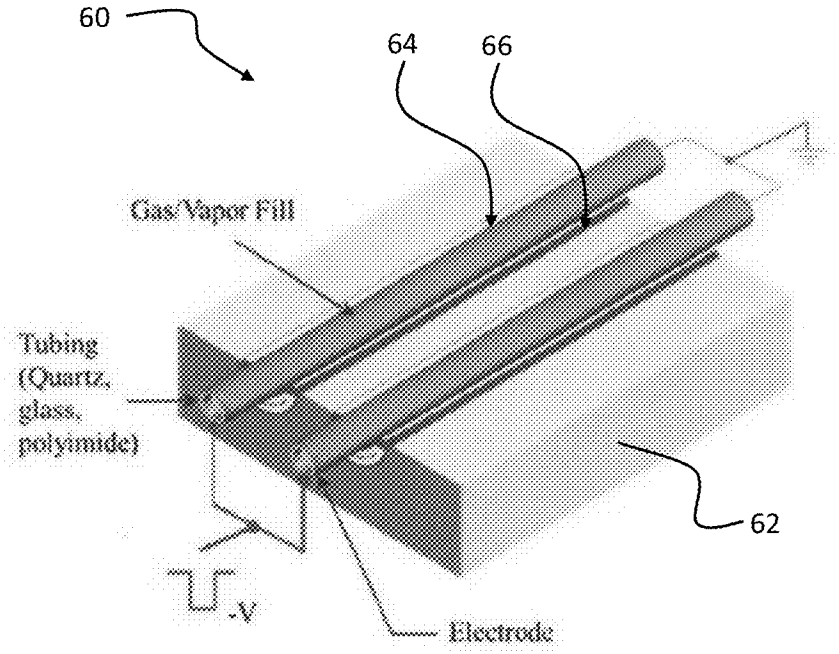
Figure 12:
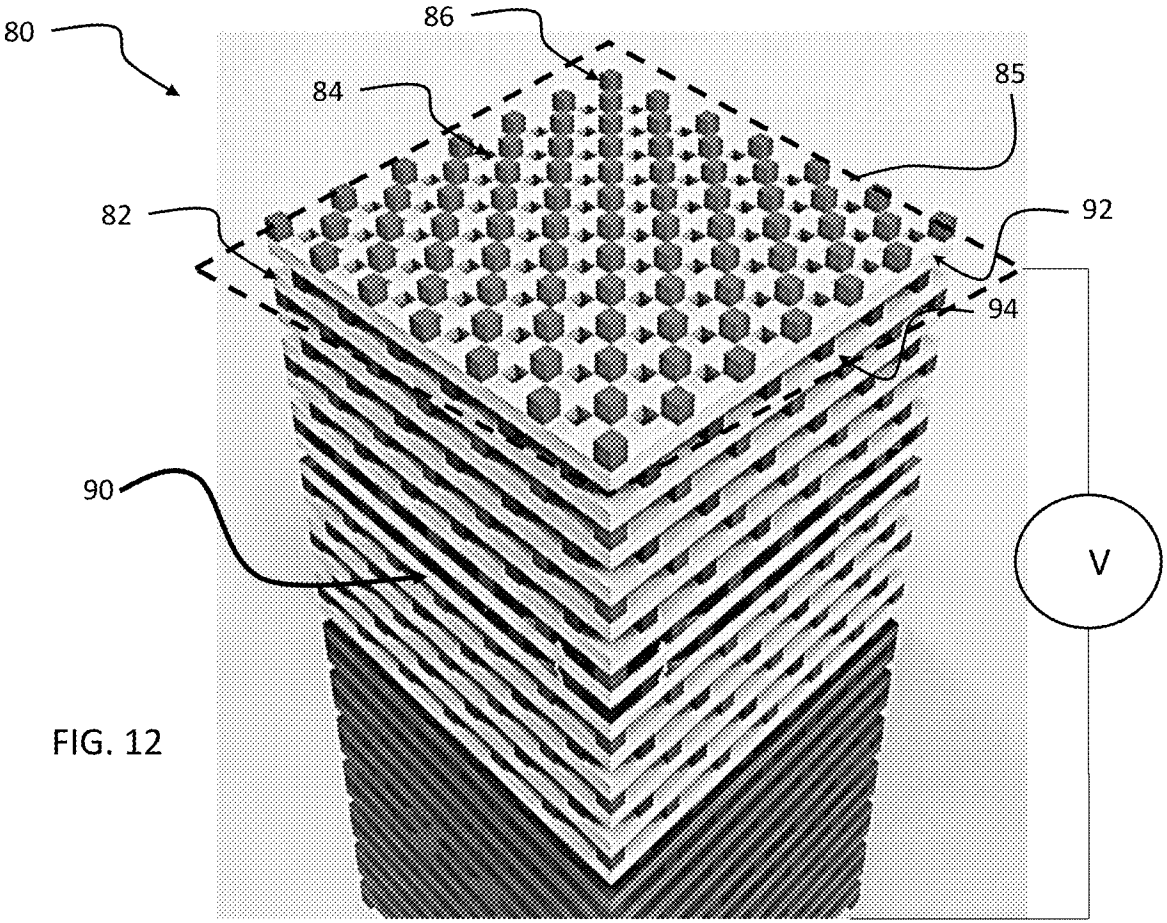
FIG. 12 is a perspective view of a layered microplasma photonic crystal in accordance with a preferred embodiment formed by a 3D printing process.

FIGS. 7A and 7B illustrates a portion of a plasma photonic crystal structure 60 that is constructed from thin wafers 62, each of which contains a one dimensional array of parallel capillaries 64. Electrodes 65 can be positioned outside the structure, as illustrated in FIG. 12, or can be embedded in a portion of the structure, as in FIGS. 5A and 5B, in a pattern the leaves a volume within the crystal structure 60 free of electrodes, e.g., the volume contains only dielectric and microcapillaries. The capillaries 64 are situated within a half-cylindrical cross-section trench that can be microfabricated by any of several processes, including replica molding. The trench can include tubes 66 that can be formed from materials such as polyimides, quartz, glass or ceramics. The capillaries are filled with a gas (such as one of the rare gases) at a pressure typically between 1 and 1000 Ton. Lower pressures are preferable because the electron-neutral collision frequency is minimized which, in turn, makes the resonances in photonic crystal spectra sharper. A series of wafers 62 can be assembled into one structure (photonic crystal "block") in which the one-dimensional arrays of capillaries comprise parallel capillaries, and the axes of the capillaries in each wafer are either parallel to those in adjacent wafers or are oriented at 90 degrees to those of adjacent wafers. More complex geometries can be produced in the wafers 62, as will be apparent to artisans. After the "block" is assembled, electrodes can be situated on the top and lower faces of the stack of arrays, and plasma is formed in the capillaries by the application of a time-varying voltage to the electrodes which can be metal or ITO films, plates, meshes, etc.

Figures 8A, 8B, 8C, 8D, 8E, 8F:
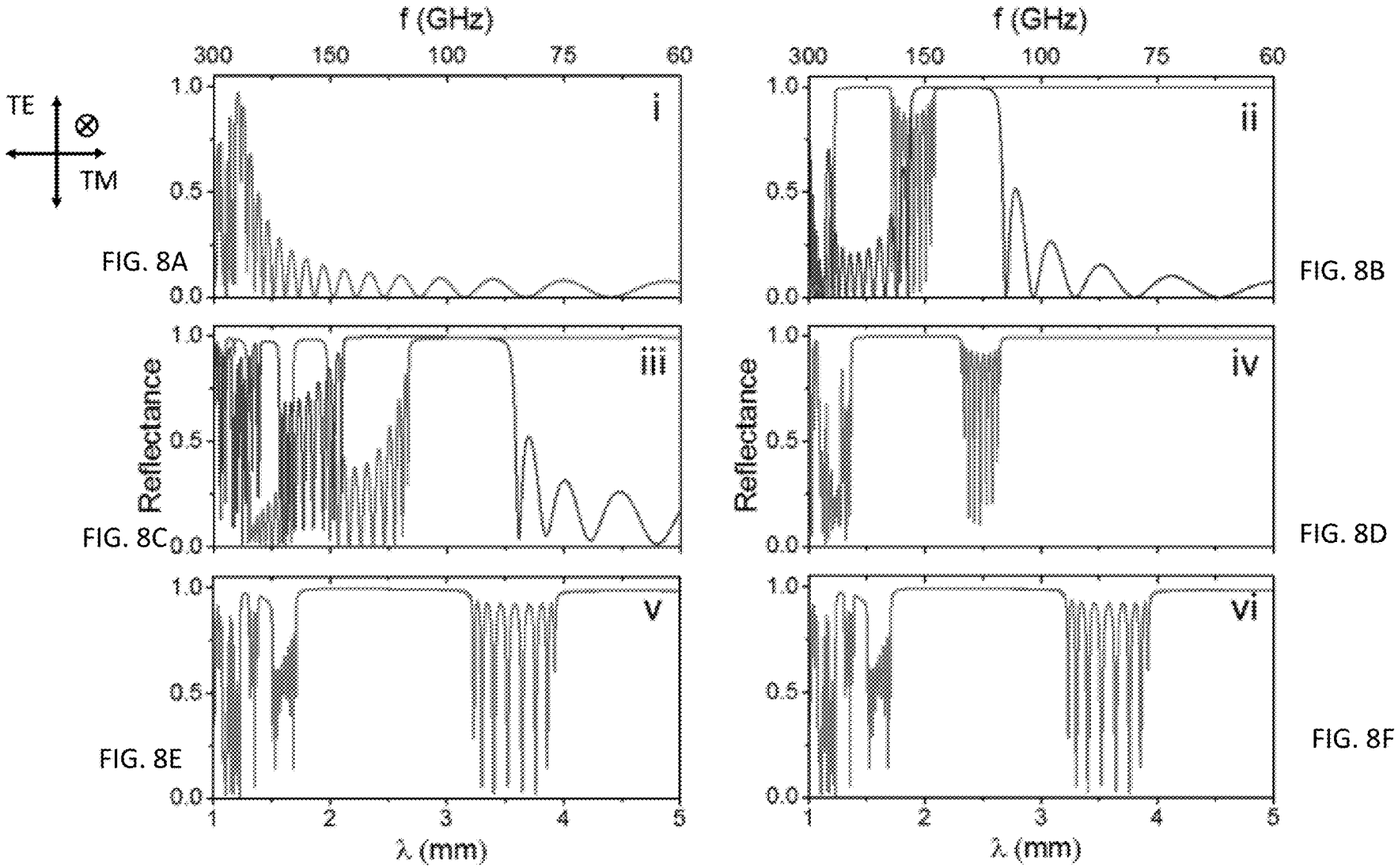
FIGS. 8A-8F include calculated reflectance spectra of a semi-infinite microplasma photonic crystal in accordance with FIG. 5A, with infinite repeating lateral units but 10 unit cells in thickness.

Additional simulations were conducted to determine the change spectral characteristics when a microplasma photonic crystal is switched from a 2D design to the super 3D geometry with waves propagating along at least one principal axis. The simulations assume the plasma columns are 450 μm in diameter with $n_e$ and ν assumed to be $10^{16}$ $cm^{-3}$ and 1 GHz, respectively. FIGS. 8A-8F include reflectance spectra calculated for a semi-infinite microplasma photonic crystal with units repeating in the lateral direction but the overall thickness of the structure is 10 unit cells. An incident, broadband plane wave is used for the simulation. Both TE (transverse electric) and TM (transverse magnetic) linearly-polarized waves were studied in this simulation. It is clear from FIGS. 8A-8F that the 2D microplasma photonic crystal exhibits a spectral response quite different from that of the 3D structure. As expected, when the incident wave propagates parallel to the plasma columns, no reflectance bands are detected (FIG. 8A).

When the wave propagation direction is perpendicular to the length of plasma column, however, a polarization dependent 2D photonic response is produced (FIG. 8B). Both TE and TM waves produce a finite photonic bandgap but at different frequencies because of the varying, anisotropic electron conductivity and, therefore, the anisotropic, effective plasma permittivity that exists both parallel and perpendicular to the orientation of the E-field. Under TM wave illumination, an infinite bandgap extending to very low frequencies is observed. The polarization-dependent structure of FIG. 8C shows a similar, but shifted, reflectance response when compared to its 2D counterpart.

Figures 8G, 8H, 8I:
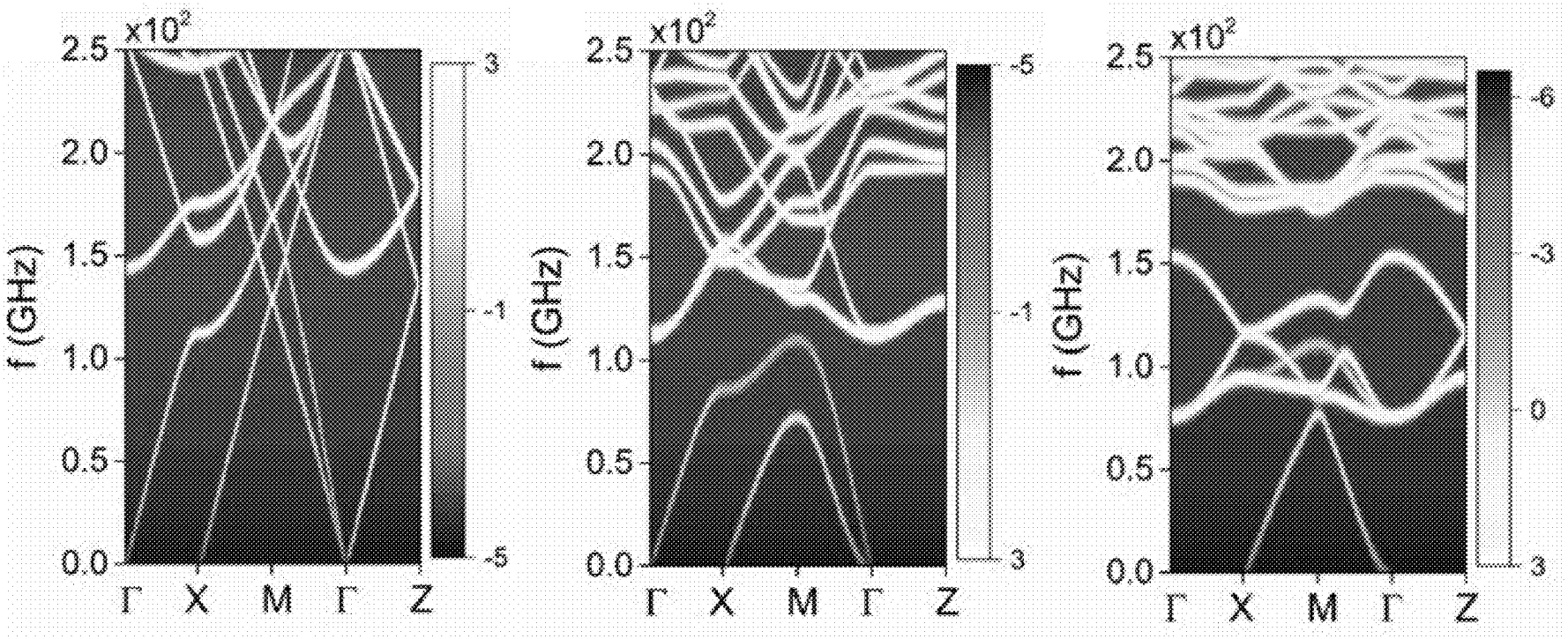
FIGS. 8G-8I are calculated band structures for respective 2D, 3D and super 3D microplasma photonic crystals in accordance with FIG. 5A.

FIGS. 8G-8I are calculated band structures for respective 2D, 3D and super 3D microplasma photonic crystals. The band structures confirm that 2D and 3D microplasma photonic crystals will have a polarization-selective stop band along two of the three primary directions.

Figure 9B:
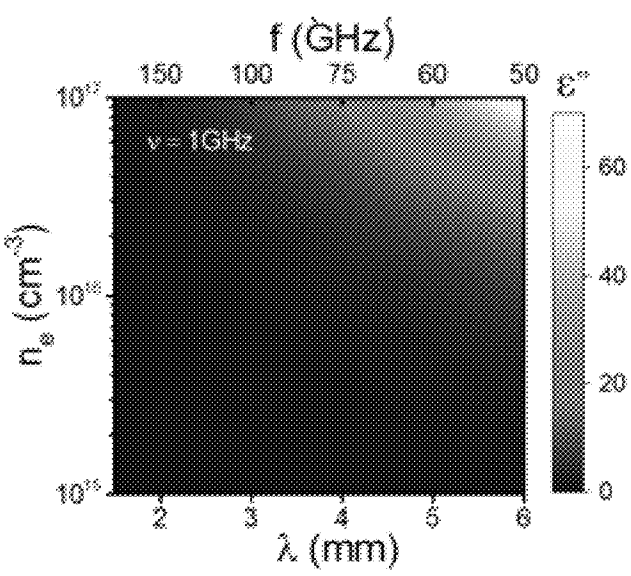
FIGS. 9A and 9B are calculated real and imaginary permittivities, respectively, for several values of electron densities in the microplasma photonic crystal in accordance with respect to a single plasma column.
Figure 9A:
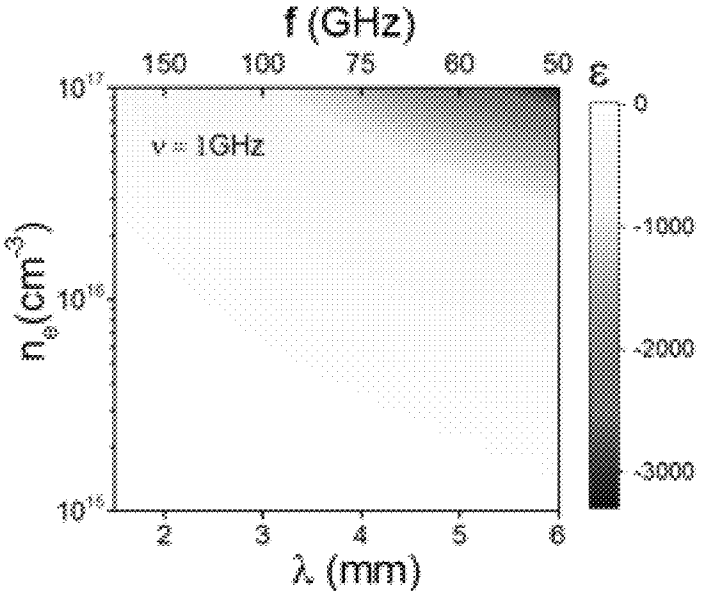

One parameter of the crystals that can be tuned in real time is $n_e$, the electron density of the plasma medium. As a direct result, ε, the most important parameter in designing plasma columns, can be changed accordingly. We have calculated the permittivity of the microplasma columns in the wavelength range of 1 mm (300 GHz) to 6 mm (50 GHz) and for $n_e$ values between $10^{15}$ $cm^{-3}$ to $10^{17}$ $cm^{-3}$ with ν assumed to be 1 GHz. Both ε and ε" are plotted in FIGS. 9A and 9B, respectively. It is clear that ε becomes negative towards longer wavelengths, as the frequency falls below $\omega_p$, indicating that the real part of the refractive index is large and the contrast with the background medium is increasing. On the short wavelength side of the spectrum, ε is almost 0 for $n_e=10^{15}$ $cm^3$ and is negative in sign.

Figure 9D:
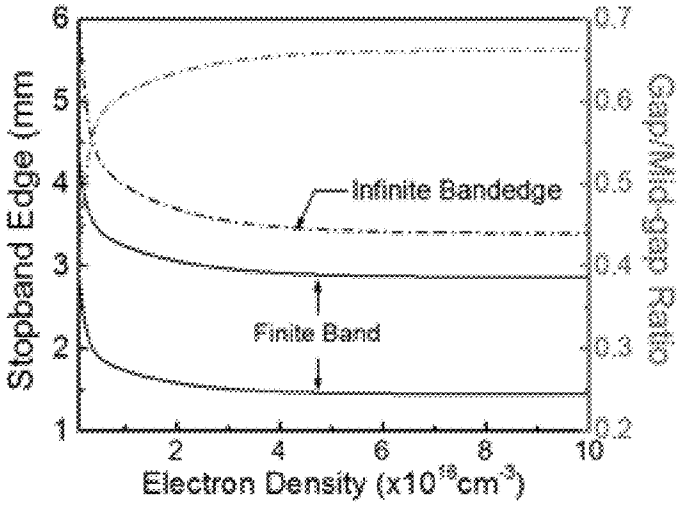
FIGS. 9C and 9D are calculated respective spectrum and stop band properties for the microplasma photonic crystal in accordance with FIG. 5A.
Figure 9C:
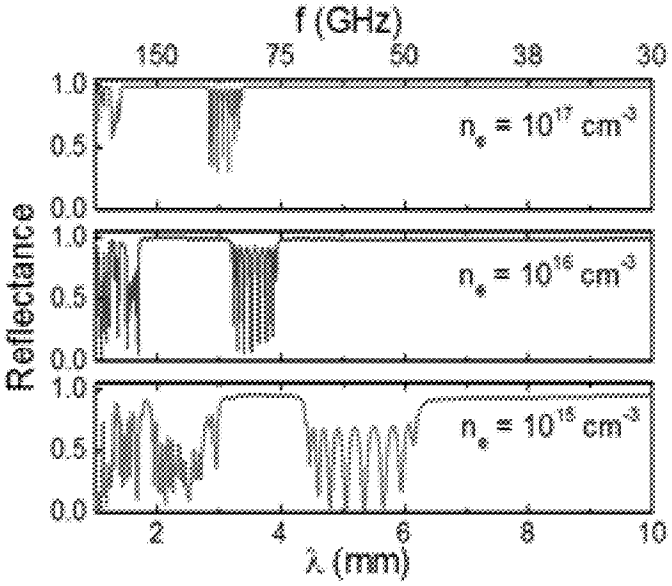

The spectra response under different $n_e$, but fixed in ν, is also considered. The spectra shown in FIG. 9C are reflectance spectra for three $n_e$ values. The spectra shift to the blue as $n_e$ increases, which is to say that the bands move in the direction of $\omega_p$. It is also can be seen that the reflectance reaches 100% for high values of $n_e$, which indicates that fewer layers are required to open a bandgap. Spectra calculated for a much finer sized increment in $n_e$ are plotted in FIG. 9D. It is interesting to see that the finite band position shifts quickly when $n_e$ is increased from $10^{15}$ $cm^{-3}$ to $2\times10^{16}$ $cm^{-3}$. Further increases in $n_e$ will not change the band position significantly and the band edges stabilize for $n_e=4\times10^{16}$ $cm^{-3}$. Considering that the lattice constant of the example microplasma photonic crystal is 1 mm, these results suggest that the band positions are determined more by the periodicity a than $n_e$. Further blue shifting of the band can be realized by reducing the lattice size rather than increasing $n_e$. It is worth noting that an increase in $n_e$ not only results in changes in the stop band position, but also significantly improves the band strength from ~35% to over 65%, a quantity that is of great importance for broad band signal control.

Figure 10B:
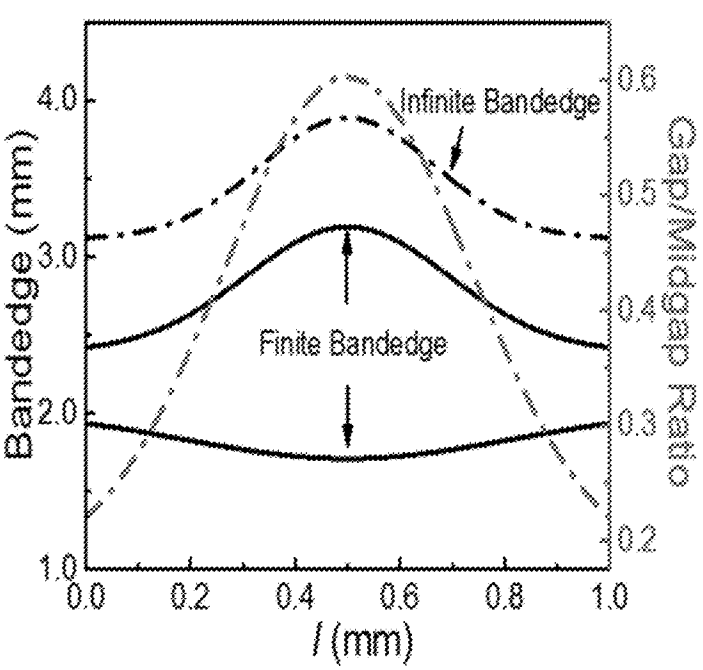
FIGS. 10A and 10B show the calculated stop band tuning as a function of plasma column diameter and plasma column layer-to-layer spacing in the microplasma photonic crystal in accordance with FIG. 5B.
Figure 10A:
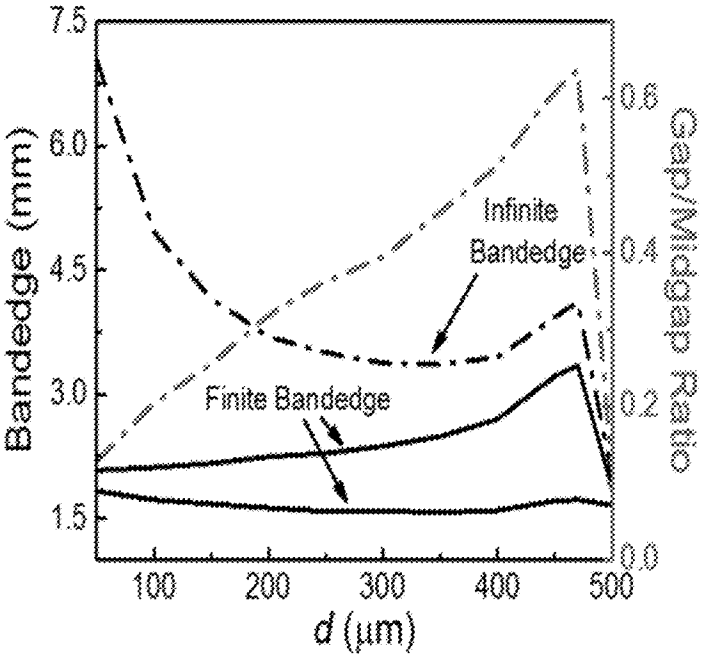

Additional simulations of the structure concerned configurability by changing dimensionality, and permittivity tuning by changing $n_e$. FIGS. 10A and 10B evaluate the signal tunability from the design parameters of plasma column diameters (d) and layer spacing (l) between the intersecting plasma columa layers. FIG. 10A evaluates the range of d from 50 μm to 500 μm that is practically achievable with increment of 50 μm under a consistent $n_e$ of $10^{16}$ $cm^{-3}$ and ν of 1 GHz. With the small diameters, the increment in d broadens the reflectance band gradually, with the short wavelength side of the band edge mostly staying consistent and the long side band edge slowly pushes to the red. Such changes are similar to the solid material dielectric photonic crystals in that the band strength increases when the filling fraction gets higher. The infinite band edge is also pushed to shorter wavelengths with the increasing d all the way up to ~400 μm, indicating in certain range, the higher filling fraction of plasma column will lead to the increase in the stop band edge frequency as the microplasma photonic crystal is becoming less "diluted" with higher filling fraction. Therefore, the effective cut off frequency approaches that of the $\omega_p$ of bulk plasma.

Similar spectrum tuning response is expected from changing plasma column to plasma column gap distance l. This is a practical parameter to vary as one can plasma columns on a moving stage with controllable layer to layer spacing. As a simplification, we construct the simulation based on the super 3D unit cell structure, with d fixed to be 450 μm. Again, $n_e$ and ν are set to be $10^{16}$ $cm^{-3}$ and 1 GHz. The plasma columns along the propagation direction are fixed, and only the gap between the in two orthogonal plasma column layers normal to the propagation direction is changed, without altering the lattice constant. By changing l from 0 μm to 1000 μm, we see an oscillation in the gap positions as shown in FIG. 10B. The maximum band gap (i.e. 1.6 mm/3.1 mm, >60% gap/mid-gap ratio) appears when the plasma columns entering through the center of two adjacent orthogonal plasma column layers (i.e. 500 μm to each side). Symmetric signals are found when the plasma columns are off-center and moving closer to either side. In this mariner, the smallest band gaps (i.e. 1.9 mm/2.4 mm, 23%) take place when the orthogonal plasma columns are intersecting through each other. Throughout the entire process, the conduction band edge stay mostly static but the valence band edge change significantly by over 25%. The infinite band edge sweeps in the similar manner with the long wavelength band edge, and leaves a transmitting band oscillating between the two strong reflecting regions.

The simulated results were calculated with plasma columns and background material with refractive index equal 1, which assumes that plasma are discharged in air or low index material, such as porous dielectrics, as in the FIG. 5A embodiment. Gas break down inside tubes composed of transparent solid materials as in the FIGS. 7A and 7B embodiment avoids interference of the gas flow between adjacent plasma columns allows plasma medium to be sealed inside tubes with partial pressure. A representative n=2.5 can be used to indicate the high index medium, a rational number to use which resembles the refractive index of glass or polymer at millimeter wavelengths. Under this circumstance, the reflectance peaks shifted to longer wavelength due to higher index contrast and increased capacitance. Near perfect reflectance signals again appears at intermediate $n_e$.

Figures 11A, 11B:
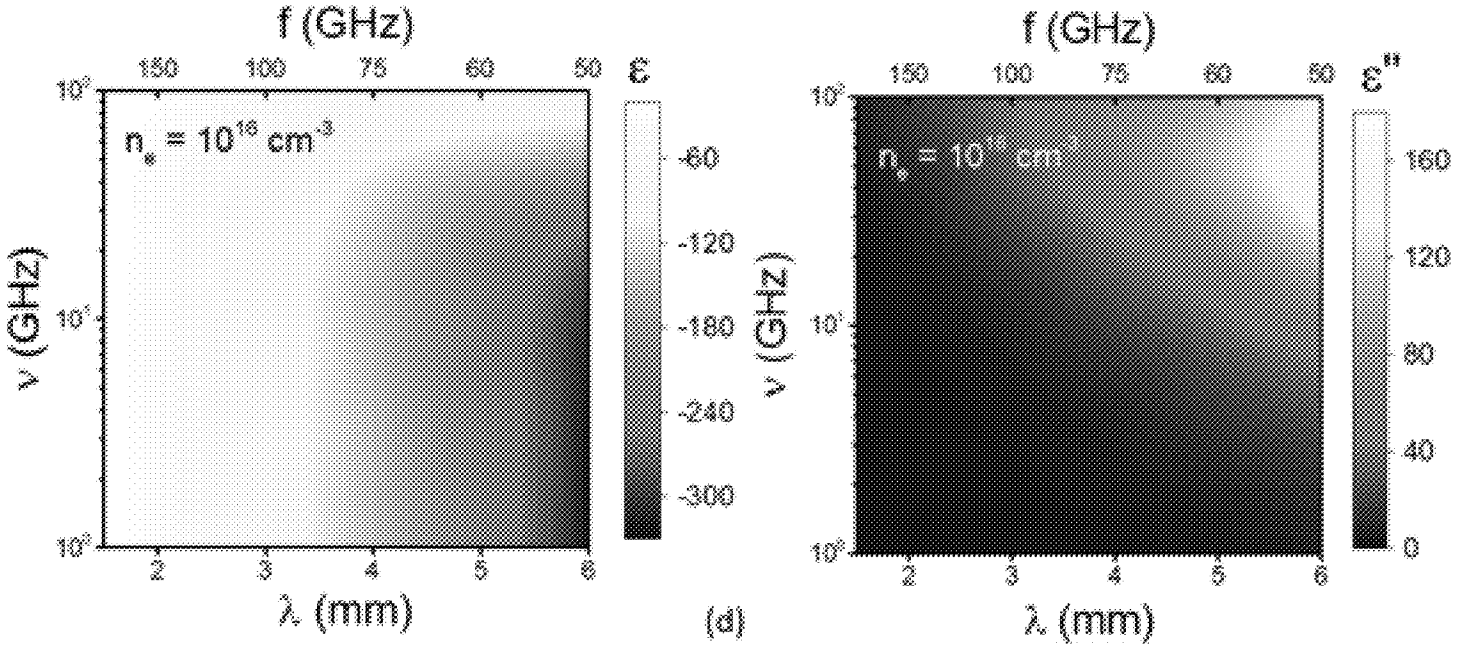
FIGS. 11A and 11B are calculated real and imaginary permittivities, respectively, for different electron densities in a microplasma photonic crystal under electron density of $ne=10^{16}$ $cm^{-3}$ and different collisional frequencies.
Figure 11D:
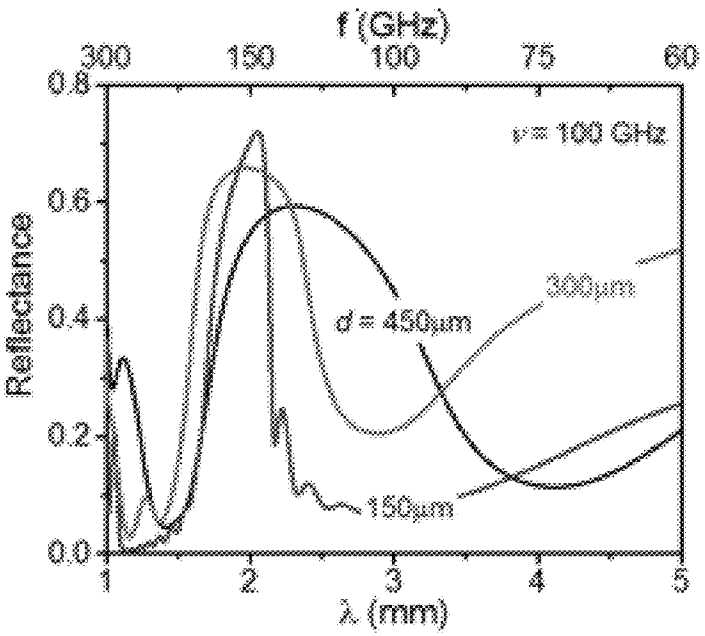
FIGS. 11C and 11D are calculated respective spectral and stop band properties in a microplasma photonic crystal for the same electron density ($10^{16}$ $cm^{-3}$) and different collisional frequencies and for different plasma column diameters.
Figure 11C:
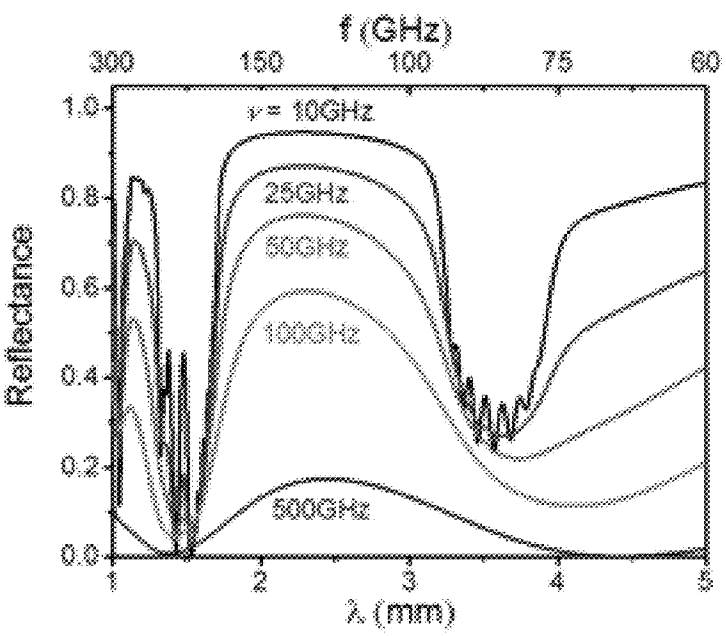

The simulations assumed that the microplasma photonic crystals were driven under lower ν level. The effects under higher ν levels were also calculated. We first reassess the optical properties of plasma under fixed $n_e$ of $10^{16}$ $cm^{-3}$ but varying ν between 1 GHz to 100 GHz. The results are summarized in FIGS. 11A and 11B for ε and ε" for wavelengths from 1 mm to 6 mm. As a first impression, higher ν will result in less negative ε and more positive in ε", which is an implication that the material is lossier under high collision level that cause signal dissipation. The spectra shown in FIG. 11C are the reflectance simulated under the same conditions with previous studied super 3D structure except for various ν at 1 GHz, 10 GHz, 50 GHz and 100 GHz. Because of the signal dissipation, the reflectance intensity decreases with the increasing ν. Although not ideal under high collision, these results are promising in terms of spectral selected reflection or absorption at least at ν=100 GHz, as little light is transmitted due to dissipation. When higher signal contrast is needed, one of the practical ways is to reduce the plasma column diameter (i.e. reducing the filling fraction, and therefore), although by doing this, advantages in band strength and angular independence might be reduced.

Simulation data were obtained with Lumerical FDTD solutions, a commercially available simulation software for photonics and electromagnetism. The simulation time was set to be $2\times10^7$ fs, with mesh size to be 40×40×40 μm. Periodic boundaries along lateral directions (xy plane normal to the incident electromagnetic wave) were used during simulation, which assumes an infinite repeating units along this plane while along z directions, a finite number of units between 1 to 10 periods are used during the simulation. Broadband plane wave with wavelength between 0.8 and 7.5 mm were used as the incident wave. External incident plane wave was used for simulating the reflectance and transmission spectrum. For simulation on the photonic band structure, dipole clouds are placed in the proximity of plasma column and all be confined in a unit cell.

Additional embodiments are formed via a layer to layer printing process. This process has been used to form experimental microplasma photonic crystals. A periodic structure having discrete confined microplasmas in a volume large than 16.25 cubic cm (up to now) was fabricated and can, for example, can serve as a reconfigurable bandpass filter, beam splitter or router, attenuator, or phase shifter for frequencies up to and beyond 1 THz. The mm-wave transmission responses from 110-170 GHz have been recorded, with the emphasis the strong responses to the 120±10 GHz, and 160±10 GHz.

Figure 13C:
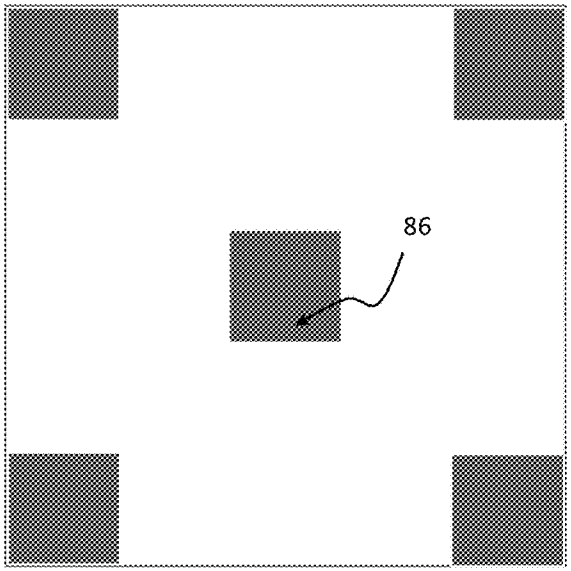
FIGS. 13A-13C illustrate example periodic patterns of the spacers and openings in adjacent layers of the microplasma photonic crystal of FIG. 12.
Figure 13B:
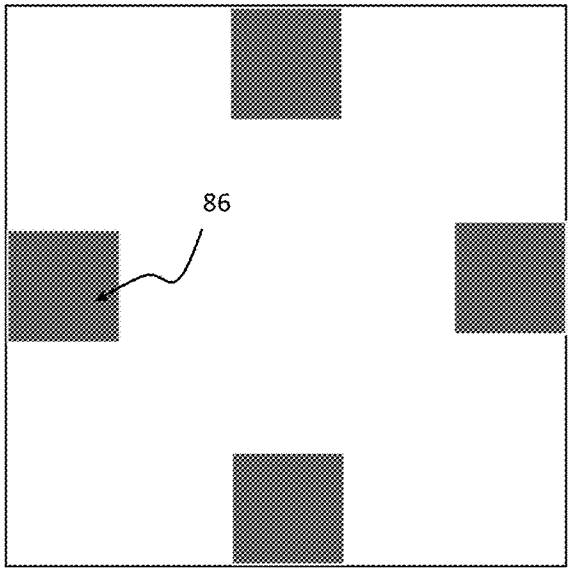
Figure 13A:
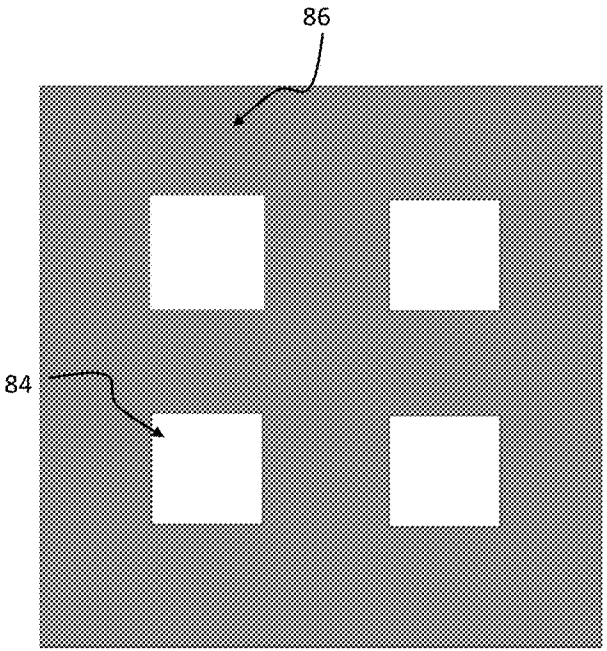

Such additional preferred embodiments of the invention are realized by microfabricating multilayered structures in which each dielectric layer has periodic structures in the plane of the layer. In the direction orthogonal to each layer, the device has a period consisting of at least two layers. Regions between the layers can be partially or wholly filled with plasma. FIG. 12 shows such a preferred 3D microplasma photonic crystal 80. Individual scaffold layers 82 define openings 84 of arbitrary shape that confine discrete plasmas. Scaffold layers 82 include and are separated by pillar shaped spacers 86. Each scaffold layer 82 has a periodic arrangement of openings 84 and pillar spacers 86 in the plane of the layer. Electrodes 85 (only one is shown in dotted lines) are at the top and bottom of the whole structure, such that there are no electrodes in the interaction volume of the crystal where microplasma and incident electromagnetic energy interact. The electrodes 85 are preferably transparent, such as indium tin oxide, formed as a coating on topmost and bottommost layers 82. Electromagnetic energy enters through a side 90 that defines a window via transparent packaging (transparent to the incident electromagnetic energy of interest) and exits an opposite side through windows that are on at least two sides and can be used to enclose the entire crystal 80, or can be including in packaging that seals the crystal with a plasma medium therein. The entire crystal 80 can be, for example, a couple or few millimeters in all three directions to form a rectangular prism or a cube, e.g. having a largest side horizontal, height or depth dimension in the range of ~2-10 mm. Other shapes can include cylinder shaped layers, which can be used to form sphere shaped or cone shaped volumes by varying the two dimensional size of each layer. Each layer 82 can be fabricated by a number of suitable processes, including 3D printing, laser cutting, and replica molding. Polymers and plastics are preferred materials. Layers have been successfully fabricated in polyimide sheets. Glass and quartz are additional materials that can be used. A power source 87 powers the electrodes with a time-varying voltage to generate plasma in the openings 84. The pattern of openings 84 and spacers 86 is different in adjacent layers such that a periodic pattern of discrete microplasmas is established during operation in three dimensions. The pattern can be established with two layers, four layers, eight layers, etc., and then repeat in periodic fashion. In the crystal 80 of FIG. 12, a pattern of confined, discrete plasmas is generated in the openings 84 of individual scaffold layers. As can be seen in FIG. 12, the pillar shaped spacers 86 and openings 84 are in different positions in a top layer 92 than a next layer 94. Some or all of the spacers in the layer 94 will align with openings in the layer 92 and vice versa. That is, in the embodiment of FIG. 12, the structure fabricated into the odd-numbered layers is the same, and that for all of the even-numbered layers is the same. Therefore, two adjacent layers comprise one period in the structure of the photonic crystal of FIG. 12 along the vertical coordinate. This is illustrated in FIGS. 13A-C, which show that openings 84 and spacers 86 switch positions via a fabrication process that uses a base layer in FIG. 13A and then adds one of two separate patterns of spacers/columns 86 from FIG. 13B or 13C. The process then continues with adding another layer of FIG. 13A and then the other of the pattern of FIG. 13B or 13C and so forth. Depending on the fabrication process, this can produce unitary pillars/layers or bonded pillars/layers. Example devices in accordance with FIGS. 12-13C can have square cross-section openings 84 and spaces 86 that have sides of in the range of 1-1000 μm. The layers and spacers can have height in the range of 1-1000 μm. The openings and pillars can also have different cross-section, such as circular, oval, triangular, etc. The cross-section and minimum opening sizes are only limited by the fabrication process and materials used. Variations in the periodicity and dimensions provide the ability for achieving highly tunable and reconfigurable material systems for electromagnetic responses in the millimeter wave or extremely high frequency regimes. For electromagnetic applications such as those described here, the dimensions of the pillars 86 and openings 84 should be a fraction of a wavelength for the desired frequency range. For operation of the crystal at 150 GHz, for example, the width of the square pillars is 300 μm, or 0.15 times the wavelength of 2 mm.

Figure 14A:
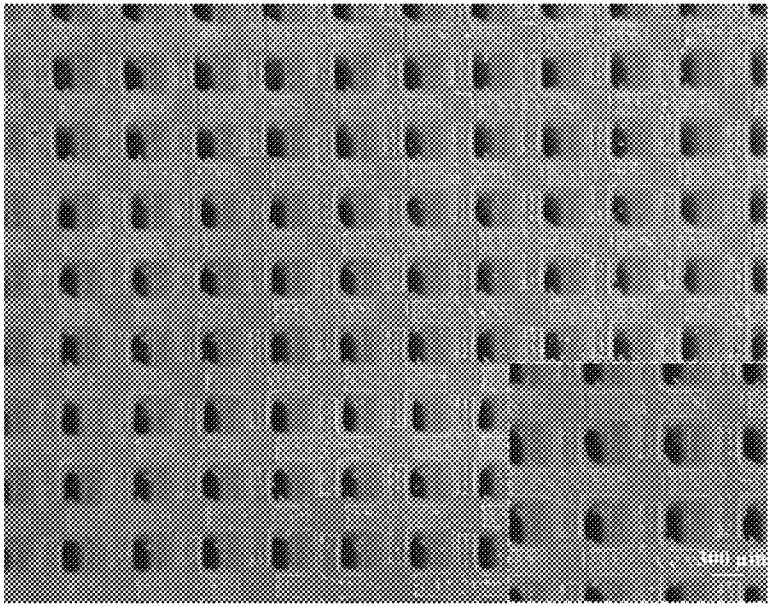
FIGS. 14A and 14B are images of the experimental device in accordance with FIG. 12, both with and without plasma generated within the device.
Figure 14B:
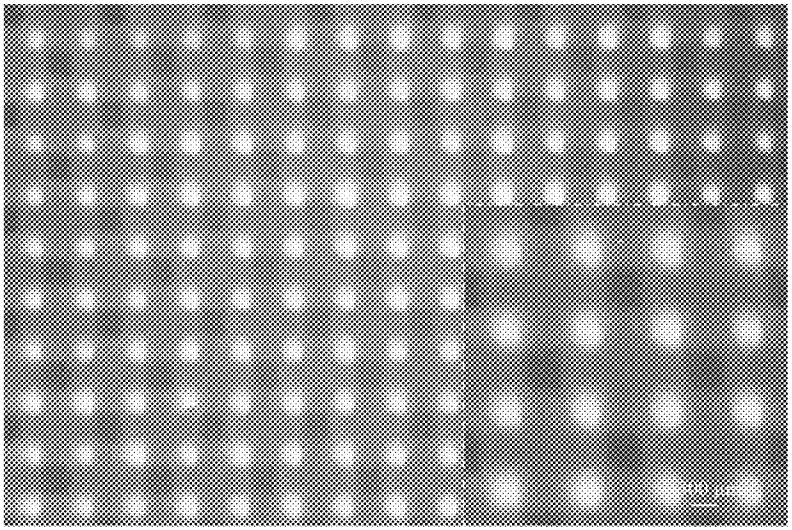

Experiments probing the electromagnetic properties of devices of the invention have been conducted in the 110-170 GHz (sub-mm) region of the electromagnetic spectrum by directing tunable radiation at the structure of FIG. 12 along the direction parallel to the layers. That is, the layered structures were probed "broadside" and a detector behind the layered device recorded the power of the transmitted radiation. FIG. 14A shows an image of an experimental device according to FIG. 12, and FIG. 14B the device with plasma columns active. The experimental devices were formed from Acrylonitrile-Butadiene-Styrene with a 3D Stereolithography printing method. Each layer can be built through many methods, like 3D printing, laser cutting, replica molding. The material is not limited to polymer and plastic. The unit layers have been successfully accomplished through polyimide sheet, glass and quartz.

Figure 15:
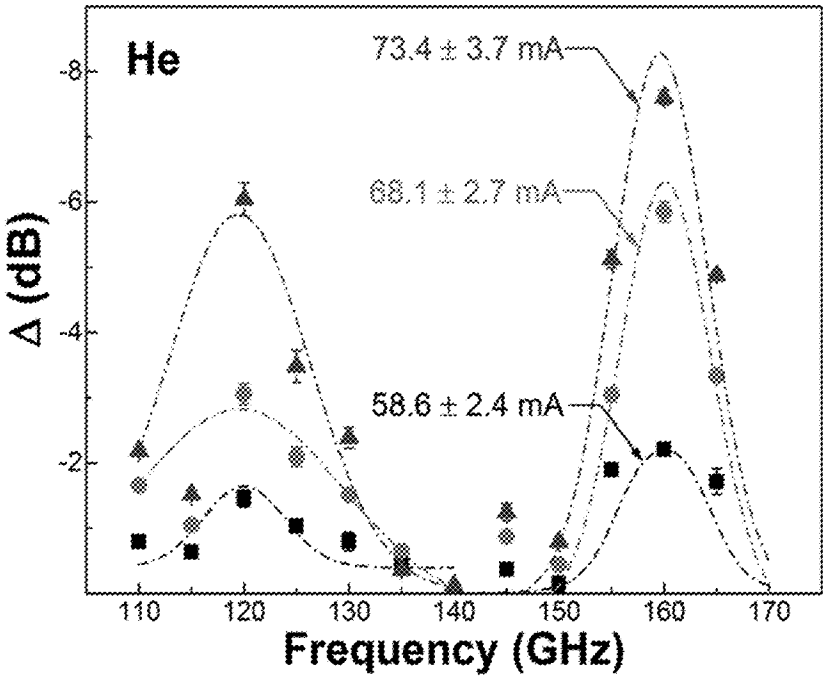
FIG. 15 is a graph of the dependence on frequency (110-170 GHz) of transmission for the experimental 3D plasma photonic crystal in accordance with FIG. 12 for different values of power input, and helium serving as the gas (plasma medium)
Figure 16:
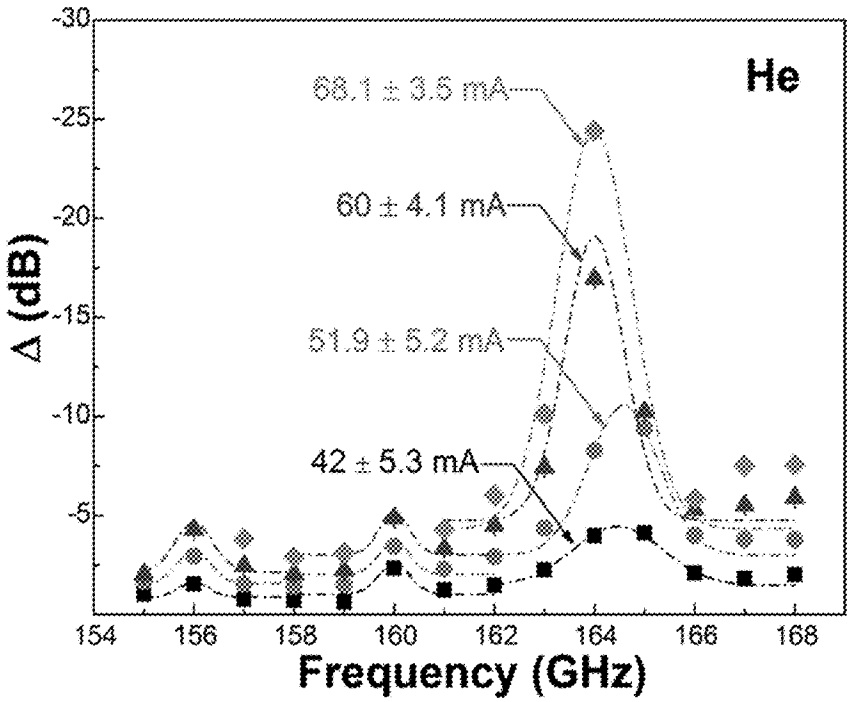
FIG. 16 is a graph of the dependence on frequency (155-168 GHz) of transmission for the experimental 3D plasma photonic crystal in accordance with FIG. 12 for different values of power input, and helium serving as the gas (plasma medium)
Figure 17:
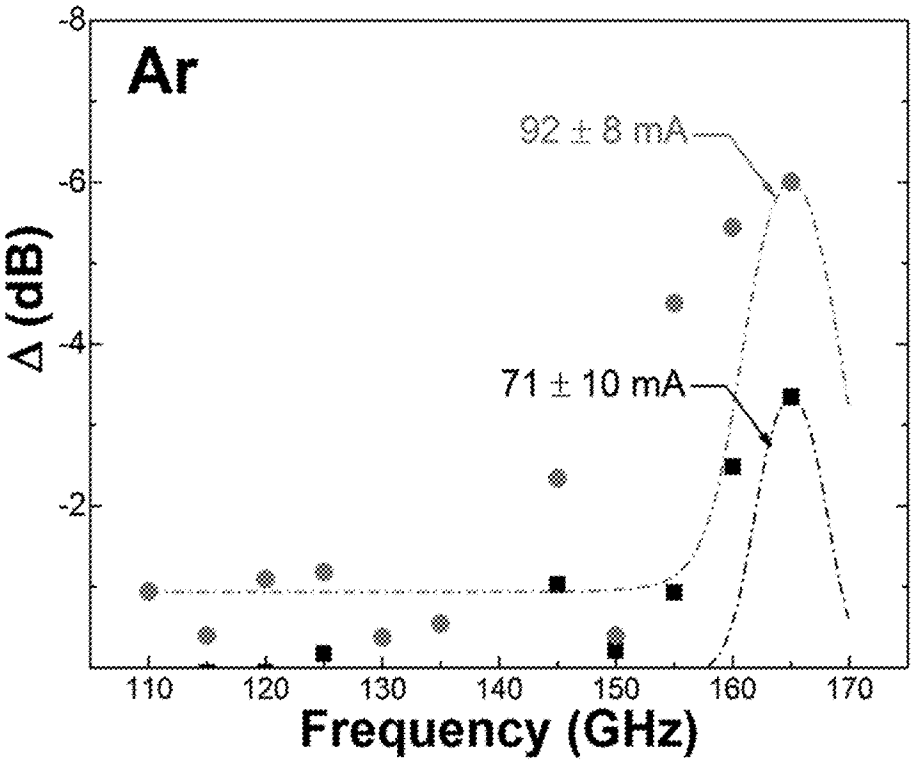
FIG. 17 is a graph of the dependence on frequency (110-170 GHz) of transmission for the experimental 3D plasma photonic crystal in accordance with FIG. 12 for different values of power input, and argon serving as the gas (plasma medium)
Figure 18:
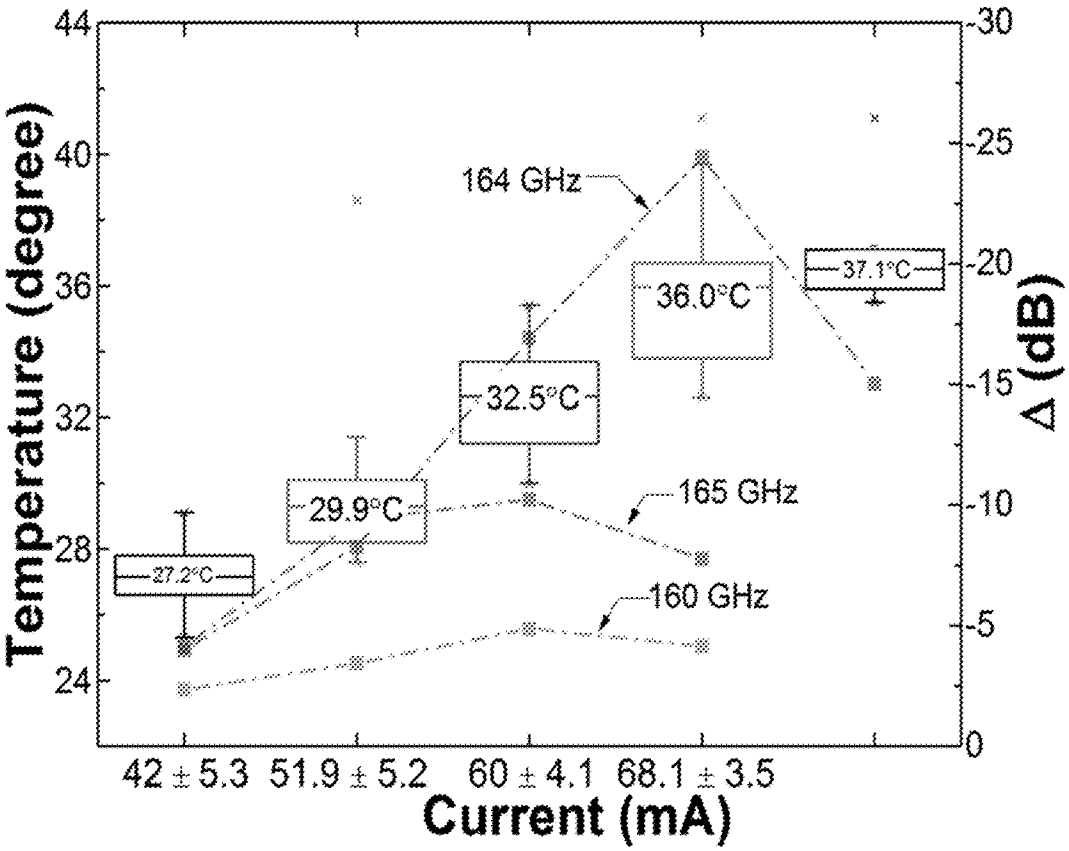
FIG. 18 is a graph of the dependence of millimeter wave transmission for the experimental 3D plasma photonic crystal in accordance with FIG. 12 for different values of input power and temperature, and helium serving as the gas (plasma medium).

FIG. 15 plots dependence on frequency (110-170 GHz) of transmission for the experimental 3D plasma photonic crystal in accordance with FIG. 12 under different power input, with input gas (plasma medium) as helium. FIG. 16 plots dependence on frequency (155-168 GHz) of transmission for the experimental 3D plasma photonic crystal in accordance with FIG. 12 under different power input, with input gas (plasma medium) as helium. FIG. 17 plots the dependence on frequency (110-170 GHz) of transmission for the experimental 3D plasma photonic crystal in accordance with FIG. 12 for different values of power input, and argon serving as the gas (plasma medium). FIG. 18 plots the dependence of millimeter wave transmission for the experimental 3D plasma photonic crystal in accordance with FIG. 12 for different values of input power and temperature, and helium serving as the gas (plasma medium).

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims

The invention claimed is:

1. A method of reflecting, transmitting and/or resonating incident electromagnetic energy, the method comprising steps of:

generating a periodic array of discrete microplasmas in a dielectric structure with arrays of elongate microcavities that open to an interaction volume and arrays of electrodes disposed within the dielectric structure between the arrays of elongate microcavities, wherein the generating generates non-disperse microplasma columns extending into the interaction volume having a column-to-column pitch, average electron density and plasma column diameter selected to produce a photonic response to incident electromagnetic energy in the interaction volume, and wherein the interaction volume is a volume free of electrodes; and interacting the incident electromagnetic energy with the microplasma columns to reflect, transmit and/or resonate the incident electromagnetic energy.

2. The method of claim 1, wherein the periodic array comprises a 1D array of microplasma columns having diameters in the range of ~50-500 μm.

3. The method of claim 1, wherein the periodic array comprises a 2D array of microplasma columns having diameters in the range of ~50-500 μm.

4. The method of claim 1, wherein said generating generates the microplasma columns as microplasma jets.

5. The method of claim 1, wherein said generating generates the microplasma columns in micro capillaries.

6. The method of claim 1, wherein said generating generates an array of discrete microplasmas confined by a periodic, layered dielectric structure.

7. The method of claim 1, wherein said generating generates the microplasma with an electron density ranging from $10^{14}$ $cm^{-3}$ to $10^{17}$ $cm^{-3}$.

8. The method of claim 7, wherein the electromagnetic energy has a frequency less than the plasma frequency of the microplasma.

9. The method of claim 1, wherein the electromagnetic energy has a frequency less than the plasma frequency of the microplasma.

10. The method of claim 1, wherein the dielectric structure comprises a plurality of layers separate from each other and adjacent layers include orthogonal microtubes that each individually confines a discrete single microplasma of the periodic array of discrete microplasmas.

11. A method of reflecting, transmitting and/or resonating incident electromagnetic energy, the method comprising steps of:

generating a periodic array of discrete microplasmas in a volume free of electrodes, wherein the array has a pitch and average electron density selected to produce a photonic response to the incident electromagnetic energy; and interacting the incident electromagnetic energy with the microplasma columns to reflect, transmit and/or resonate the incident electromagnetic energy, wherein the periodic array comprises a 3D array of intersecting or interleaved microplasma columns.

12. The method of claim 11, wherein the 3D array of microplasma columns comprises a cubic lattice.

13. The method of claim 12, wherein the cubic lattice comprises variation in pitch.

14. The method of claim 11, wherein the 3D array of microplasma columns comprises interleaved columns.

15. The method of claim 11, wherein the 3D array of microplasma columns comprises intersecting columns.

16. A microplasma photonic crystal for reflecting, transmitting and/or resonating incident electromagnetic energy, the crystal comprising:

a dielectric structure with arrays of elongate microcavities that open to an interaction volume and arrays of electrodes disposed within the dielectric structure between and in close proximity to the arrays of elongate microcavities;

wherein the arrays of elongate microcavities comprises a periodic array configured to generate non-disperse microplasma columns extending into the interaction volume having a column-to-column pitch, average electron density and plasma column diameter selected to produce a photonic response to the incident electromagnetic energy in the interaction volume; and wherein the interaction volume is an empty volume free of electrodes traversed by the periodic array of microplasma columns and the incident electromagnetic energy.

17. The crystal of claim 16, wherein the arrays of electrodes surround the interaction volume.

18. The crystal of claim 17, wherein the arrays of elongate microcavities surround open to four sides of the interaction volume and opposite arrays of elongate microcavities are aligned with each other.

19. The crystal of claim 16, wherein at least one of the arrays of elongate microcavities are orthogonal to the arrays of electrodes.

20. The crystal of claim 16, comprising a layered dielectric structure with a plurality of microcapillaries in each layer and electrodes that are patterned to leave the interaction volume free of electrodes.

21. A microplasma photonic crystal for reflecting, transmitting and/or resonating incident electromagnetic energy, the crystal comprising:

a plurality of scaffold layers of dielectric, each scaffold layer comprising a periodic pattern of openings to confine discrete microplasma and pillars to separate the scaffold layer from an adjacent layer, and wherein the periodic patterns of adjacent layers are different from one another;

electrodes on separated ones of the plurality of scaffold layers; and packaging transparent to the incident electromagnetic energy on sides of the plurality of scaffold layers.

22. The crystal of claim 21, wherein the plurality of scaffold layers comprises a largest side horizontal, height or depth dimension in the range of ~2-10 mm.

* * * * *